US012312925B2

(12) United States Patent
Eitschberger et al.

(10) Patent No.: US 12,312,925 B2
(45) Date of Patent: May 27, 2025

(54) MANUALLY ORIENTED INTERNAL SHAPED CHARGE ALIGNMENT SYSTEM AND METHOD OF USE

(71) Applicant: DynaEnergetics Europe GmbH, Troisdorf (DE)

(72) Inventors: Christian Eitschberger, Munich (DE); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/069,518

(22) Filed: Dec. 21, 2022

(65) Prior Publication Data

US 2023/0193727 A1 Jun. 22, 2023

Related U.S. Application Data

(60) Provisional application No. 63/340,016, filed on May 10, 2022, provisional application No. 63/292,703, filed on Dec. 22, 2021.

(51) Int. Cl.
*E21B 43/119* (2006.01)
*E21B 43/117* (2006.01)
*E21B 43/1185* (2006.01)

(52) U.S. Cl.
CPC ..... *E21B 43/119* (2013.01); *E21B 43/117* (2013.01); *E21B 43/1185* (2013.01)

(58) Field of Classification Search
CPC ..... F42D 1/14
See application file for complete search history.

(56) References Cited

U.S. PATENT DOCUMENTS 214,754 A 4/1879 Brock et al.
1,757,288 A 5/1930 Bleecker
(Continued)

FOREIGN PATENT DOCUMENTS

AR 021476 A1 7/2002
CA 2833722 A1 5/2014
(Continued)

OTHER PUBLICATIONS

US 11,274,530 B2, 03/2022, Fitschberger et al. (withdrawn)
(Continued)

*Primary Examiner* — Kenneth L Thompson
(74) *Attorney, Agent, or Firm* — Womble Bond Dickinson (US) LLP

(57) ABSTRACT

A shaped charge orientation system may include a first perforating gun housing having a first hollow interior and a second perforating gun housing having a second hollow interior. A first shaped charge holder may be positioned in the first hollow interior and oriented in a first direction. A second shaped charge holder may be positioned in the second hollow interior and oriented in a second direction different than the first direction. A manual alignment tool may engage with the second perforating gun housing to rotate the second shaped charge holder from the second direction to the first direction. A method of manually aligning the first and second shaped charge holders may include marking an outer surface of the first perforating gun housing with a visual indicator in alignment with the first direction, and orienting the second shaped charge holder into alignment in the first direction using a manual alignment tool.

20 Claims, 11 Drawing Sheets

(56) References Cited

U.S. PATENT DOCUMENTS

| | | | |
|---|---|---|---|
| 2,062,974 | A | 12/1936 | Lane |
| 2,147,544 | A | 2/1939 | Potts |
| 2,216,359 | A | 10/1940 | Spencer |
| 2,228,873 | A | 1/1941 | Hardt et al. |
| 2,296,346 | A | 9/1942 | Hearn |
| 2,358,466 | A | 9/1944 | Miller |
| 2,418,486 | A | 4/1947 | Smylie |
| 2,439,394 | A | 4/1948 | Lanzalotti et al. |
| 2,550,004 | A | 4/1951 | Doll |
| 2,598,651 | A | 5/1952 | Spencer |
| 2,618,343 | A | 11/1952 | Conrad |
| 2,667,836 | A | 2/1954 | Church et al. |
| 2,687,092 | A | 8/1954 | Duesing |
| 2,713,909 | A | 7/1955 | Baker |
| 2,713,910 | A | 7/1955 | Baker et al. |
| 2,734,456 | A | 2/1956 | Sweetman |
| RE24,127 | E | 3/1956 | Binns et al. |
| 2,755,863 | A | 7/1956 | Stansbury et al. |
| 2,756,958 | A | 7/1956 | Binns et al. |
| 2,785,631 | A | 3/1957 | Blanchard |
| 2,807,325 | A | 9/1957 | Webb |
| 2,889,775 | A | 6/1959 | Owen |
| 2,946,283 | A | 7/1960 | Udry |
| 2,982,210 | A | 5/1961 | Andrew et al. |
| 3,013,491 | A | 12/1961 | Poulter |
| 3,077,834 | A | 2/1963 | Caldwell |
| 3,116,690 | A | 1/1964 | Gillingham et al. |
| 3,125,024 | A | 3/1964 | Hicks et al. |
| 3,140,537 | A | 7/1964 | Popoff |
| 3,154,632 | A | 10/1964 | Browne |
| 3,158,680 | A | 11/1964 | Lovitt et al. |
| 3,160,209 | A | 12/1964 | Bonner |
| 3,170,400 | A | 2/1965 | Nelson |
| 3,246,707 | A | 4/1966 | Bell |
| 3,357,355 | A | 12/1967 | Roush |
| 3,374,735 | A | 3/1968 | Moore |
| 3,504,723 | A | 4/1970 | Cushman et al. |
| D222,469 | S | 10/1971 | Flummer |
| 3,691,954 | A | 9/1972 | Kern |
| 3,731,626 | A | 5/1973 | Grayson |
| D227,763 | S | 7/1973 | Hand |
| 3,859,921 | A | 1/1975 | Stephenson |
| 3,892,455 | A | 7/1975 | Sotolongo |
| 4,007,790 | A | 2/1977 | Henning |
| 4,007,796 | A | 2/1977 | Boop |
| 4,024,817 | A | 5/1977 | Calder, Jr. et al. |
| 4,039,239 | A | 8/1977 | Cobaugh et al. |
| 4,058,061 | A | 11/1977 | Mansur, Jr. et al. |
| 4,080,902 | A | 3/1978 | Goddard et al. |
| 4,107,453 | A | 8/1978 | Erixon |
| 4,132,171 | A | 1/1979 | Pawlak et al. |
| 4,140,188 | A | 2/1979 | Vann |
| 4,172,421 | A | 10/1979 | Regalbuto |
| 4,182,216 | A | 1/1980 | DeCaro |
| 4,220,087 | A | 9/1980 | Posson |
| 4,266,613 | A | 5/1981 | Boop |
| 4,312,273 | A | 1/1982 | Camp |
| 4,319,526 | A | 3/1982 | DerMott |
| 4,346,954 | A | 8/1982 | Appling |
| 4,363,529 | A | 12/1982 | Loose |
| 4,411,491 | A | 10/1983 | Larkin et al. |
| 4,455,941 | A | 6/1984 | Walker et al. |
| 4,485,741 | A | 12/1984 | Moore et al. |
| 4,491,185 | A | 1/1985 | McClure |
| 4,496,008 | A | 1/1985 | Pottier et al. |
| 4,523,650 | A | 6/1985 | Sehnert et al. |
| 4,534,423 | A | 8/1985 | Regalbuto |
| 4,537,132 | A | 8/1985 | Sabranski et al. |
| 4,566,544 | A | 1/1986 | Bagley et al. |
| 4,574,892 | A | 3/1986 | Grigar et al. |
| 4,583,602 | A | 4/1986 | Ayers |
| 4,598,775 | A | 7/1986 | Vann et al. |
| 4,609,057 | A | 9/1986 | Walker et al. |
| 4,619,333 | A | 10/1986 | George |
| 4,621,396 | A | 11/1986 | Walker et al. |
| 4,637,478 | A | 1/1987 | George |
| 4,640,370 | A | 2/1987 | Wetzel |
| 4,650,009 | A | 3/1987 | McClure et al. |
| 4,657,089 | A | 4/1987 | Stout |
| 4,660,910 | A | 4/1987 | Sharp et al. |
| 4,730,793 | A | 3/1988 | Thurber, Jr. et al. |
| 4,739,839 | A | 4/1988 | Regalbuto et al. |
| 4,747,201 | A | 5/1988 | Donovan et al. |
| 4,762,067 | A | 8/1988 | Barker et al. |
| 4,776,393 | A | 10/1988 | Forehand et al. |
| 4,784,061 | A | 11/1988 | Christopher |
| 4,790,383 | A | 12/1988 | Savage et al. |
| 4,798,244 | A | 1/1989 | Trost |
| 4,800,815 | A | 1/1989 | Appledorn et al. |
| 4,808,925 | A | 2/1989 | Baird |
| 4,859,196 | A | 8/1989 | Durando et al. |
| 4,862,804 | A | 9/1989 | Chawla et al. |
| 4,881,445 | A | 11/1989 | Hayes |
| 4,885,993 | A | 12/1989 | Hancock et al. |
| 4,889,183 | A | 12/1989 | Sommers et al. |
| 4,998,478 | A | 3/1991 | Beck |
| 5,001,981 | A | 3/1991 | Shaw |
| 5,006,833 | A | 4/1991 | Marlowe et al. |
| 5,010,821 | A | 4/1991 | Blain |
| 5,024,270 | A | 6/1991 | Bostick |
| 5,027,708 | A | 7/1991 | Gonzalez |
| 5,050,691 | A | 9/1991 | Moses |
| 5,052,489 | A | 10/1991 | Carisella et al. |
| 5,060,573 | A | 10/1991 | Montgomery et al. |
| 5,070,788 | A | 12/1991 | Carisella et al. |
| 5,083,929 | A | 1/1992 | Dalton |
| 5,088,413 | A | 2/1992 | Huber |
| 5,088,557 | A | 2/1992 | Ricles et al. |
| 5,105,742 | A | 4/1992 | Sumner |
| 5,115,196 | A | 5/1992 | Low et al. |
| 5,159,145 | A | 10/1992 | Carisella et al. |
| 5,159,146 | A | 10/1992 | Carisella et al. |
| 5,223,664 | A | 6/1993 | Rogers |
| 5,223,665 | A | 6/1993 | Burleson et al. |
| 5,237,136 | A | 8/1993 | Langston |
| 5,241,891 | A | 9/1993 | Hayes et al. |
| 5,248,055 | A | 9/1993 | Sanai et al. |
| 5,303,772 | A | 4/1994 | George et al. |
| 5,322,019 | A | 6/1994 | Hyland |
| 5,347,929 | A | 9/1994 | Lerche et al. |
| 5,358,418 | A | 10/1994 | Carmichael |
| 5,392,851 | A | 2/1995 | Arend |
| 5,392,860 | A | 2/1995 | Ross |
| 5,398,753 | A | 3/1995 | Obrejanu et al. |
| 5,398,760 | A | 3/1995 | George et al. |
| 5,436,791 | A | 7/1995 | Turano et al. |
| 5,493,068 | A | 2/1996 | Klein et al. |
| 5,501,606 | A | 3/1996 | Oda et al. |
| 5,505,135 | A | 4/1996 | Fritz et al. |
| 5,529,509 | A | 6/1996 | Hayes et al. |
| 5,540,154 | A | 7/1996 | Wilcox et al. |
| 5,558,531 | A | 9/1996 | Ikeda et al. |
| 5,603,384 | A | 2/1997 | Bethel et al. |
| 5,648,635 | A | 7/1997 | Lussier et al. |
| 5,671,899 | A | 9/1997 | Nicholas et al. |
| 5,673,760 | A | 10/1997 | Brooks et al. |
| 5,679,032 | A | 10/1997 | Auclair |
| 5,703,319 | A | 12/1997 | Fritz et al. |
| 5,753,850 | A | 5/1998 | Chawla et al. |
| 5,759,056 | A | 6/1998 | Costello et al. |
| 5,765,962 | A | 6/1998 | Cornell et al. |
| 5,769,661 | A | 6/1998 | Nealis |
| 5,775,426 | A | 7/1998 | Snider et al. |
| 5,785,130 | A | 7/1998 | Wesson et al. |
| 5,792,977 | A | 8/1998 | Chawla |
| 5,797,761 | A | 8/1998 | Ring |
| 5,816,343 | A | 10/1998 | Markel et al. |
| 5,820,402 | A | 10/1998 | Chiacchio et al. |
| 5,831,204 | A | 11/1998 | Lubben et al. |
| 5,837,924 | A | 11/1998 | Austin |
| 5,837,925 | A | 11/1998 | Nice |
| 5,871,052 | A | 2/1999 | Benson et al. |
| 5,927,402 | A | 7/1999 | Benson et al. |
| D417,252 | S | 11/1999 | Kay |

(56) References Cited

U.S. PATENT DOCUMENTS 5,992,289 A 11/1999 George et al.
5,992,523 A 11/1999 Burleson et al.
D418,210 S 12/1999 Roesch
6,006,833 A 12/1999 Burleson et al.
6,012,525 A 1/2000 Burleson et al.
6,021,095 A 2/2000 Tubel et al.
6,032,733 A 3/2000 Ludwig et al.
6,056,058 A 5/2000 Gonzalez
6,085,659 A 7/2000 Beukes et al.
6,098,707 A 8/2000 Pastusek et al.
6,102,724 A 8/2000 Ring
6,112,666 A 9/2000 Murray et al.
6,148,263 A 11/2000 Brooks et al.
6,182,765 B1 2/2001 Kilgore
6,216,596 B1 4/2001 Wesson
6,263,283 B1 7/2001 Snider et al.
6,269,875 B1 8/2001 Harrison, III et al.
6,297,447 B1 10/2001 Burnett et al.
6,298,915 B1 * 10/2001 George ..... E21B 43/119 166/255.2
6,305,287 B1 10/2001 Capers et al.
6,315,461 B1 11/2001 Cairns
6,333,699 B1 12/2001 Zierolf
6,349,649 B1 2/2002 Jacoby et al.
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,408,758 B1 6/2002 Duguet
6,412,388 B1 7/2002 Frazier
6,412,415 B1 7/2002 Kothari et al.
6,412,573 B2 7/2002 Vaynshteyn
6,413,117 B1 7/2002 Annerino et al.
6,418,853 B1 7/2002 Duguet et al.
6,419,044 B1 7/2002 Tite et al.
6,431,269 B1 8/2002 Post et al.
6,453,817 B1 9/2002 Markel et al.
6,454,011 B1 9/2002 Schempf et al.
6,457,526 B1 10/2002 Dailey
6,464,011 B2 10/2002 Tubel
6,467,415 B2 10/2002 Menzel et al.
6,474,931 B1 11/2002 Austin et al.
6,488,093 B2 12/2002 Moss
6,497,285 B2 12/2002 Walker
6,508,176 B1 1/2003 Badger et al.
6,510,796 B2 1/2003 Mayseless et al.
6,516,901 B1 2/2003 Falgout
6,584,406 B1 6/2003 Harmon et al.
6,595,290 B2 7/2003 George et al.
6,619,176 B2 9/2003 Renfro et al.
6,651,747 B2 11/2003 Chen et al.
6,659,180 B2 12/2003 Moss
6,668,726 B2 12/2003 Lussier
6,702,009 B1 3/2004 Drury et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,772,868 B2 8/2004 Warner
6,779,605 B2 8/2004 Jackson
6,808,021 B2 10/2004 Zimmerman et al.
6,820,693 B2 11/2004 Hales et al.
6,843,317 B2 1/2005 Mackenzie
6,890,191 B1 5/2005 Thorburn
6,902,414 B2 6/2005 Dopf et al.
6,938,689 B2 9/2005 Farrant et al.
6,941,871 B2 9/2005 Mauldin
6,966,262 B2 11/2005 Jennings, III
6,966,378 B2 11/2005 Hromas et al.
6,976,857 B1 12/2005 Shukla et al.
6,988,449 B2 1/2006 Teowee et al.
7,000,699 B2 2/2006 Yang et al.
7,013,977 B2 3/2006 Nordaas
7,018,164 B2 3/2006 Anthis et al.
7,036,598 B2 5/2006 Skjærseth et al.
7,044,219 B2 5/2006 Mason et al.
7,044,225 B2 5/2006 Haney et al.
7,044,230 B2 5/2006 Starr et al.
7,066,261 B2 6/2006 Vicente et al.
7,074,064 B2 7/2006 Wallace
7,082,877 B2 8/2006 Jennings, III
7,093,664 B2 8/2006 Todd et al.
7,114,564 B2 10/2006 Parrott et al.
D532,947 S 11/2006 Muscarella
7,140,453 B2 11/2006 Ayling
7,168,494 B2 1/2007 Starr et al.
7,182,611 B2 2/2007 Borden et al.
7,182,625 B2 2/2007 Machado et al.
7,193,156 B2 3/2007 Alznauer et al.
7,193,527 B2 3/2007 Hall
7,204,308 B2 4/2007 Dudley et al.
7,217,917 B1 5/2007 Tumlin et al.
7,234,521 B2 6/2007 Shammai et al.
7,234,525 B2 6/2007 Alves et al.
7,237,486 B2 7/2007 Myers, Jr. et al.
7,237,626 B2 7/2007 Gurjar et al.
7,240,742 B2 7/2007 Sewell et al.
7,273,102 B2 9/2007 Sheffield
7,278,491 B2 10/2007 Scott
7,299,903 B2 11/2007 Rockwell et al.
7,306,038 B2 12/2007 Challacombe
7,331,394 B2 2/2008 Edwards et al.
7,347,145 B2 3/2008 Teowee et al.
7,347,278 B2 3/2008 Lerche et al.
7,350,448 B2 4/2008 Bell et al.
7,353,879 B2 4/2008 Todd et al.
7,357,083 B2 4/2008 Takahara et al.
7,364,451 B2 4/2008 Ring et al.
7,373,974 B2 5/2008 Connell et al.
7,387,162 B2 6/2008 Mooney, Jr. et al.
7,404,725 B2 7/2008 Hall et al.
7,405,358 B2 7/2008 Emerson
7,441,601 B2 10/2008 George et al.
7,461,580 B2 12/2008 Bell et al.
7,464,647 B2 12/2008 Teowee et al.
7,481,662 B1 1/2009 Rehrig
7,540,758 B2 6/2009 Ho
7,553,078 B2 6/2009 Hanzawa et al.
7,565,927 B2 7/2009 Gerez et al.
7,568,429 B2 8/2009 Hummel et al.
7,574,960 B1 8/2009 Dockery et al.
7,588,080 B2 9/2009 McCoy
7,607,379 B2 10/2009 Rospek et al.
7,617,775 B2 11/2009 Teowee
7,631,704 B2 12/2009 Hagemeyer et al.
7,640,857 B2 1/2010 Kneisl
7,661,366 B2 2/2010 Fuller et al.
7,661,474 B2 2/2010 Campbell et al.
7,681,500 B2 3/2010 Teowee
7,690,306 B1 4/2010 King
7,712,416 B2 5/2010 Pratt et al.
7,726,396 B2 6/2010 Briquet et al.
7,735,578 B2 6/2010 Loehr et al.
7,748,447 B2 7/2010 Moore
7,752,971 B2 7/2010 Loehr
7,762,172 B2 7/2010 Li et al.
7,762,351 B2 7/2010 Vidal
7,778,006 B2 8/2010 Stewart et al.
7,794,243 B1 9/2010 Rzasa et al.
7,810,430 B2 10/2010 Chan et al.
7,823,508 B2 11/2010 Anderson et al.
7,845,431 B2 12/2010 Eriksen et al.
7,901,247 B2 3/2011 Ring
7,908,970 B1 3/2011 Jakaboski et al.
7,929,270 B2 4/2011 Hummel et al.
7,952,035 B2 5/2011 Falk et al.
7,980,309 B2 7/2011 Crawford
7,980,874 B2 7/2011 Finke et al.
8,006,765 B2 8/2011 Richards et al.
8,028,624 B2 10/2011 Mattson
8,038,453 B2 10/2011 Robicheau et al.
8,052,490 B2 11/2011 Bernasch et al.
8,056,632 B2 11/2011 Goodman
8,061,425 B2 11/2011 Hales et al.

(56) References Cited

U.S. PATENT DOCUMENTS

| | | | |
|---|---|---|---|
| 8,066,083 | B2 | 11/2011 | Hales et al. |
| 8,069,789 | B2 | 12/2011 | Hummel et al. |
| 8,074,737 | B2 | 12/2011 | Hill et al. |
| 8,079,296 | B2 | 12/2011 | Barton et al. |
| 8,127,846 | B2 | 3/2012 | Hill et al. |
| 8,136,585 | B2 | 3/2012 | Cherewyk |
| 8,141,434 | B2 | 3/2012 | Kippersund et al. |
| 8,151,882 | B2 | 4/2012 | Grigar et al. |
| 8,157,022 | B2 | 4/2012 | Bertoja et al. |
| 8,181,718 | B2 | 5/2012 | Burleson et al. |
| 8,182,212 | B2 | 5/2012 | Parcell |
| 8,186,259 | B2 | 5/2012 | Burleson et al. |
| 8,230,932 | B2 | 7/2012 | Ratcliffe et al. |
| 8,256,337 | B2 | 9/2012 | Hill |
| 8,264,814 | B2 | 9/2012 | Love et al. |
| 8,281,851 | B2 | 10/2012 | Spence |
| 8,297,345 | B2 | 10/2012 | Emerson |
| 8,317,448 | B2 | 11/2012 | Hankins et al. |
| 8,322,284 | B2 | 12/2012 | Meddes et al. |
| 8,322,413 | B2 | 12/2012 | Bishop et al. |
| 8,327,746 | B2 | 12/2012 | Behrmann et al. |
| 8,336,437 | B2 | 12/2012 | Barlow et al. |
| 8,342,094 | B2 | 1/2013 | Marya et al. |
| 8,395,878 | B2 | 3/2013 | Stewart et al. |
| 8,413,727 | B2 | 4/2013 | Holmes |
| D682,384 | S | 5/2013 | Jaureguizar |
| 8,449,308 | B2 | 5/2013 | Smith |
| 8,451,137 | B2 | 5/2013 | Bonavides et al. |
| 8,464,624 | B2 | 6/2013 | Asahina et al. |
| 8,469,087 | B2 | 6/2013 | Gray |
| 8,479,830 | B2 | 7/2013 | Denoix et al. |
| 8,505,632 | B2 | 8/2013 | Guerrero et al. |
| D689,590 | S | 9/2013 | Brose |
| 8,540,021 | B2 | 9/2013 | McCarter et al. |
| 8,561,683 | B2 | 10/2013 | Wood et al. |
| 8,582,275 | B2 | 11/2013 | Yan et al. |
| 8,596,378 | B2 | 12/2013 | Mason et al. |
| D698,904 | S | 2/2014 | Milligan et al. |
| 8,646,520 | B2 | 2/2014 | Chen |
| 8,661,978 | B2 | 3/2014 | Backhus et al. |
| 8,678,666 | B2 | 3/2014 | Scadden et al. |
| 8,689,868 | B2 | 4/2014 | Lerche et al. |
| 8,695,506 | B2 | 4/2014 | Lanclos |
| 8,695,716 | B2 | 4/2014 | Ravensbergen |
| 8,726,995 | B2 | 5/2014 | Bell et al. |
| 8,726,996 | B2 | 5/2014 | Busaidy et al. |
| 8,752,650 | B2 | 6/2014 | Gray |
| 8,769,795 | B2 | 7/2014 | Kash et al. |
| 8,770,301 | B2 | 7/2014 | Bell |
| D712,013 | S | 8/2014 | Mather et al. |
| 8,807,003 | B2 | 8/2014 | Le et al. |
| 8,810,247 | B2 | 8/2014 | Kuckes |
| 8,826,821 | B2 | 9/2014 | Martin |
| 8,863,665 | B2 | 10/2014 | DeVries et al. |
| 8,875,787 | B2 | 11/2014 | Tassaroli |
| 8,881,816 | B2 | 11/2014 | Glenn et al. |
| 8,881,836 | B2 | 11/2014 | Ingram |
| 8,884,778 | B2 | 11/2014 | Lerche et al. |
| 8,899,322 | B2 | 12/2014 | Cresswell et al. |
| 8,904,935 | B1 | 12/2014 | Brown et al. |
| 8,910,718 | B2 | 12/2014 | Watson et al. |
| 8,960,093 | B2 | 2/2015 | Preiss et al. |
| 8,960,288 | B2 | 2/2015 | Sampson |
| 8,981,957 | B2 | 3/2015 | Gano et al. |
| 8,985,023 | B2 | 3/2015 | Mason |
| 8,997,852 | B1 | 4/2015 | Lee et al. |
| 9,062,539 | B2 | 6/2015 | Schmidt et al. |
| 9,065,191 | B2 | 6/2015 | Martin et al. |
| 9,080,433 | B2 | 7/2015 | Lanclos et al. |
| 9,115,572 | B1 | 8/2015 | Hardesty et al. |
| 9,133,695 | B2 | 9/2015 | Xu |
| 9,145,748 | B1 | 9/2015 | Meier et al. |
| 9,145,763 | B1 | 9/2015 | Sites, Jr. |
| 9,181,790 | B2 | 11/2015 | Mace et al. |
| 9,194,219 | B1 | 11/2015 | Hardesty et al. |
| 9,206,675 | B2 | 12/2015 | Hales et al. |
| 9,270,051 | B1 | 2/2016 | Christiansen et al. |
| 9,284,819 | B2 | 3/2016 | Tolman et al. |
| 9,284,824 | B2 | 3/2016 | Fadul et al. |
| 9,285,199 | B2 | 3/2016 | Beikoff |
| 9,291,039 | B2 | 3/2016 | King et al. |
| 9,317,038 | B2 | 4/2016 | Ozick et al. |
| 9,328,577 | B2 | 5/2016 | Hallundbaek et al. |
| 9,359,863 | B2 | 6/2016 | Streich et al. |
| 9,359,884 | B2 | 6/2016 | Hallundbaek et al. |
| 9,382,783 | B2 | 7/2016 | Langford et al. |
| 9,382,784 | B1 | 7/2016 | Hardesty et al. |
| 9,383,237 | B2 | 7/2016 | Wiklund et al. |
| 9,453,382 | B2 | 9/2016 | Carr et al. |
| 9,464,508 | B2 | 10/2016 | Lerche et al. |
| 9,466,916 | B2 | 10/2016 | Li et al. |
| 9,476,289 | B2 | 10/2016 | Wells |
| 9,484,646 | B2 | 11/2016 | Thomas |
| 9,494,021 | B2 | 11/2016 | Parks et al. |
| 9,518,443 | B2 | 12/2016 | Tunget et al. |
| 9,518,454 | B2 | 12/2016 | Current et al. |
| 9,523,255 | B2 | 12/2016 | Andrzejak |
| 9,556,725 | B2 | 1/2017 | Fripp et al. |
| 9,570,897 | B2 | 2/2017 | Dobrinski et al. |
| 9,574,416 | B2 | 2/2017 | Wright et al. |
| 9,581,422 | B2 | 2/2017 | Preiss et al. |
| 9,587,439 | B2 | 3/2017 | Lamik-Thonhauser et al. |
| 9,593,548 | B2 | 3/2017 | Hill et al. |
| 9,605,937 | B2 | 3/2017 | Eitschberger et al. |
| 9,612,093 | B2 | 4/2017 | Collier et al. |
| 9,617,829 | B2 | 4/2017 | Pale et al. |
| 9,634,427 | B2 | 4/2017 | Lerner et al. |
| 9,677,363 | B2 | 6/2017 | Schacherer et al. |
| 9,689,223 | B2 | 6/2017 | Schacherer et al. |
| 9,689,226 | B2 | 6/2017 | Barbee et al. |
| 9,702,669 | B1 | 7/2017 | Powell |
| 9,725,993 | B1 | 8/2017 | Yang et al. |
| 9,726,005 | B2 | 8/2017 | Hallundbaek et al. |
| 9,735,405 | B1 | 8/2017 | Petkus et al. |
| 9,752,385 | B2 | 9/2017 | Hay et al. |
| 9,784,549 | B2 | 10/2017 | Eitschberger |
| 9,790,763 | B2 | 10/2017 | Fripp et al. |
| 9,797,238 | B2 | 10/2017 | Frosell et al. |
| 9,822,618 | B2 | 11/2017 | Eitschberger |
| 9,835,015 | B2 | 12/2017 | Hardesty |
| D807,991 | S | 1/2018 | Fitzhugh et al. |
| 9,862,027 | B1 | 1/2018 | Loehken |
| 9,874,083 | B2 | 1/2018 | Logan et al. |
| 9,890,604 | B2 | 2/2018 | Wood et al. |
| 9,903,185 | B2 | 2/2018 | Ursi et al. |
| 9,903,192 | B2 | 2/2018 | Entchev et al. |
| 9,909,376 | B2 | 3/2018 | Hrametz et al. |
| 9,915,513 | B1 | 3/2018 | Zemla et al. |
| 9,926,750 | B2 | 3/2018 | Ringgenberg |
| 9,926,755 | B2 | 3/2018 | Van Petegem et al. |
| 9,926,765 | B2 | 3/2018 | Goodman et al. |
| 9,963,955 | B2 | 5/2018 | Tolman et al. |
| 10,000,994 | B1 | 6/2018 | Sites |
| 10,047,591 | B2 | 8/2018 | Bell et al. |
| 10,047,592 | B2 | 8/2018 | Burgos et al. |
| 10,054,414 | B2 | 8/2018 | Scheid et al. |
| 10,066,921 | B2 | 9/2018 | Eitschberger |
| 10,077,641 | B2 | 9/2018 | Rogman et al. |
| 10,138,713 | B2 | 11/2018 | Tolman et al. |
| 10,151,152 | B2 | 12/2018 | Wight et al. |
| 10,151,180 | B2 | 12/2018 | Robey et al. |
| 10,151,181 | B2 | 12/2018 | Lopez et al. |
| 10,174,595 | B2 | 1/2019 | Knight et al. |
| 10,180,050 | B2 | 1/2019 | Hardesty |
| 10,190,398 | B2 | 1/2019 | Goodman et al. |
| 10,196,886 | B2 | 2/2019 | Tolman et al. |
| 10,208,573 | B2 | 2/2019 | Kaenel et al. |
| 10,246,952 | B2 | 4/2019 | Trydal et al. |
| 10,267,603 | B2 | 4/2019 | Marshall et al. |
| 10,287,873 | B2 | 5/2019 | Filas et al. |
| 10,301,910 | B2 | 5/2019 | Whitsitt et al. |
| 10,321,594 | B2 | 6/2019 | Zhu et al. |
| 10,323,484 | B2 | 6/2019 | Liess |
| 10,337,270 | B2 | 7/2019 | Carisella et al. |

(56) References Cited

U.S. PATENT DOCUMENTS 10,358,880 B2 7/2019 Metcalf et al.
10,422,195 B2 9/2019 LaGrange et al.
10,429,161 B2 10/2019 Parks et al.
10,458,213 B1 10/2019 Eitschberger et al.
10,465,488 B2 11/2019 Collins et al.
10,472,901 B2 11/2019 Engel et al.
10,472,938 B2 11/2019 Parks et al.
D873,373 S 1/2020 Hartman et al.
D877,286 S 3/2020 Hartman et al.
10,605,018 B2 3/2020 Schmidt et al.
10,641,068 B2 * 5/2020 Hardesty ..... E21B 43/119
10,669,822 B2 6/2020 Eitschberger
10,677,026 B2 6/2020 Sokolove et al.
10,731,443 B2 * 8/2020 Von Kaenel ..... E21B 43/117
10,739,115 B2 8/2020 Loehken et al.
10,844,697 B2 11/2020 Preiss et al.
10,900,334 B2 1/2021 Knight et al.
10,954,761 B2 3/2021 Kaenel et al.
D921,858 S 6/2021 Eitschberger et al.
11,125,056 B2 9/2021 Parks et al.
11,156,066 B2 * 10/2021 Sullivan ..... E21B 43/116
11,168,546 B2 11/2021 Melhus et al.
11,204,224 B2 12/2021 Mcnelis
11,255,147 B2 2/2022 Eitschberger et al.
11,293,271 B1 * 4/2022 Hoelscher ..... E21B 43/117
11,339,614 B2 5/2022 Mulhern et al.
11,391,127 B1 * 7/2022 Hoelscher ..... E21B 43/119
11,525,344 B2 12/2022 Eitschberger et al.
11,555,385 B2 * 1/2023 Ursi ..... E21B 17/043
11,655,692 B2 * 5/2023 Wood ..... E21B 43/119
166/297
11,834,934 B2 * 12/2023 Prisbell ..... E21B 43/117
2001/0052303 A1 12/2001 Mayseless et al.
2002/0017214 A1 2/2002 Jacoby et al.
2002/0020320 A1 2/2002 Lebaudy et al.
2002/0036101 A1 3/2002 Huhdanmaki et al.
2002/0040783 A1 4/2002 Zimmerman et al.
2002/0062991 A1 5/2002 Farrant et al.
2002/0129941 A1 9/2002 Alves et al.
2002/0134552 A1 9/2002 Moss
2003/0000411 A1 1/2003 Cernocky et al.
2003/0001753 A1 1/2003 Cernocky et al.
2003/0183113 A1 10/2003 Barlow et al.
2004/0094305 A1 5/2004 Skjærseth et al.
2004/0141279 A1 7/2004 Amano et al.
2004/0211862 A1 10/2004 Elam
2004/0216632 A1 11/2004 Finsterwald
2004/0239521 A1 12/2004 Zierolf
2005/0011645 A1 1/2005 Aronstam et al.
2005/0103526 A1 5/2005 Ayling
2005/0115448 A1 6/2005 Pratt et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0217844 A1 10/2005 Edwards et al.
2005/0218260 A1 10/2005 Corder et al.
2005/0229805 A1 10/2005 Myers, Jr. et al.
2005/0257710 A1 11/2005 Monetti et al.
2005/0269083 A1 12/2005 Burris, II et al.
2006/0013282 A1 1/2006 Hanzawa et al.
2006/0054326 A1 3/2006 Alves et al.
2006/0082152 A1 4/2006 Neves
2007/0084336 A1 4/2007 Neves
2007/0125540 A1 6/2007 Gerez et al.
2007/0158071 A1 7/2007 Mooney et al.
2007/0267195 A1 11/2007 Grigar et al.
2008/0047456 A1 2/2008 Li et al.
2008/0047716 A1 2/2008 McKee et al.
2008/0110612 A1 5/2008 Prinz et al.
2008/0110632 A1 5/2008 Beall
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.
2008/0223587 A1 9/2008 Cherewyk
2008/0264639 A1 10/2008 Parrott et al.
2009/0050322 A1 2/2009 Hill et al.
2009/0159283 A1 6/2009 Fuller et al.
2009/0159285 A1 6/2009 Goodman
2009/0183916 A1 7/2009 Pratt et al.
2009/0211760 A1 8/2009 Richards et al.
2009/0255728 A1 10/2009 Spencer et al.
2009/0272519 A1 11/2009 Green et al.
2009/0272529 A1 11/2009 Crawford
2009/0301723 A1 12/2009 Gray
2009/0308589 A1 12/2009 Bruins et al.
2010/0000789 A1 1/2010 Barton et al.
2010/0012774 A1 1/2010 Fanucci et al.
2010/0022125 A1 1/2010 Burris et al.
2010/0024674 A1 2/2010 Peeters et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Noelke et al.
2010/0288496 A1 11/2010 Cherewyk
2011/0005777 A1 1/2011 Meff
2011/0024116 A1 2/2011 McCann et al.
2011/0042069 A1 2/2011 Bailey et al.
2011/0155013 A1 6/2011 Boyer et al.
2011/0209871 A1 9/2011 Le et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0152542 A1 6/2012 Le
2012/0160483 A1 6/2012 Carisella
2012/0160491 A1 6/2012 Goodman et al.
2012/0180678 A1 7/2012 Kneisl
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli
2013/0043074 A1 2/2013 Tassaroli
2013/0048376 A1 2/2013 Rodgers et al.
2013/0056208 A1 3/2013 Xu
2013/0062055 A1 3/2013 Tolman et al.
2013/0118342 A1 5/2013 Tassaroli
2013/0118805 A1 5/2013 Moody-Stuart et al.
2013/0168083 A1 7/2013 McCarter et al.
2013/0199843 A1 8/2013 Ross
2013/0228326 A1 9/2013 Griffith et al.
2013/0248174 A1 9/2013 Dale et al.
2013/0256464 A1 10/2013 Belik et al.
2013/0327571 A1 12/2013 Andrzejak
2014/0000877 A1 1/2014 Robertson et al.
2014/0026776 A1 1/2014 Kecskes et al.
2014/0033939 A1 2/2014 Priess et al.
2014/0053750 A1 2/2014 Lownds et al.
2014/0061376 A1 3/2014 Fisher et al.
2014/0083774 A1 3/2014 Hoult et al.
2014/0127941 A1 5/2014 Lu
2014/0131035 A1 5/2014 Entchev et al.
2014/0138090 A1 5/2014 Hill et al.
2014/0148044 A1 5/2014 Balcer et al.
2014/0166370 A1 6/2014 Silva
2014/0218207 A1 8/2014 Gano et al.
2014/0314977 A1 10/2014 Weinhold
2014/0360720 A1 12/2014 Corbeil
2015/0114626 A1 4/2015 Hatten et al.
2015/0136419 A1 5/2015 Mauldin
2015/0167410 A1 6/2015 Garber et al.
2015/0176386 A1 6/2015 Castillo et al.
2015/0209954 A1 7/2015 Hokanson
2015/0226044 A1 8/2015 Ursi et al.
2015/0275615 A1 10/2015 Rytlewski et al.
2015/0316360 A1 11/2015 Hinton et al.
2015/0330192 A1 11/2015 Rogman et al.
2015/0354310 A1 12/2015 Zaiser

(56) References Cited

U.S. PATENT DOCUMENTS

| | | | |
|---|---|---|---|
| 2015/0361774 | A1 | 12/2015 | Flores |
| 2015/0376991 | A1 | 12/2015 | Mcnelis et al. |
| 2016/0040502 | A1 | 2/2016 | Robben |
| 2016/0040520 | A1 | 2/2016 | Tolman et al. |
| 2016/0053560 | A1 | 2/2016 | Drury et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0115741 | A1 | 4/2016 | Davis |
| 2016/0144734 | A1 | 5/2016 | Wang et al. |
| 2016/0153267 | A1 | 6/2016 | Walker et al. |
| 2016/0168961 | A1 | 6/2016 | Parks et al. |
| 2016/0186513 | A1 | 6/2016 | Robertson et al. |
| 2016/0202027 | A1 | 7/2016 | Peterson et al. |
| 2016/0202033 | A1 | 7/2016 | Shahinpour et al. |
| 2016/0215592 | A1 | 7/2016 | Helms et al. |
| 2016/0223171 | A1 | 8/2016 | Gibbons et al. |
| 2016/0258240 | A1 | 9/2016 | Fripp et al. |
| 2016/0273902 | A1 | 9/2016 | Eitschberger |
| 2016/0290084 | A1 | 10/2016 | LaGrange et al. |
| 2016/0290098 | A1 | 10/2016 | Marya |
| 2016/0298404 | A1 | 10/2016 | Beckett et al. |
| 2016/0356132 | A1 | 12/2016 | Burmeister et al. |
| 2017/0009559 | A1 | 1/2017 | Spring |
| 2017/0030693 | A1 | 2/2017 | Preiss et al. |
| 2017/0032653 | A1 | 2/2017 | Crawford et al. |
| 2017/0044875 | A1 | 2/2017 | Hebebrand et al. |
| 2017/0052004 | A1 | 2/2017 | Xue |
| 2017/0052011 | A1 | 2/2017 | Parks et al. |
| 2017/0058648 | A1 | 3/2017 | Geerts et al. |
| 2017/0058649 | A1 | 3/2017 | Geerts et al. |
| 2017/0067303 | A1 | 3/2017 | Thiemann et al. |
| 2017/0067320 | A1 | 3/2017 | Zouhair et al. |
| 2017/0074078 | A1 | 3/2017 | Eitschberger |
| 2017/0145798 | A1 | 5/2017 | Robey et al. |
| 2017/0159379 | A1 | 6/2017 | Metcalf et al. |
| 2017/0167233 | A1 | 6/2017 | Sampson et al. |
| 2017/0175488 | A1 | 6/2017 | Lisowski et al. |
| 2017/0175500 | A1 | 6/2017 | Robey et al. |
| 2017/0199015 | A1 | 7/2017 | Collins et al. |
| 2017/0204687 | A1 | 7/2017 | Yorga et al. |
| 2017/0211363 | A1 | 7/2017 | Bradley et al. |
| 2017/0226814 | A1 | 8/2017 | Clemens et al. |
| 2017/0241244 | A1 | 8/2017 | Barker et al. |
| 2017/0268320 | A1 | 9/2017 | Angman et al. |
| 2017/0268326 | A1 | 9/2017 | Tao et al. |
| 2017/0268860 | A1 | 9/2017 | Eitschberger |
| 2017/0275976 | A1 | 9/2017 | Collins et al. |
| 2017/0276465 | A1 | 9/2017 | Parks et al. |
| 2017/0298716 | A1 | 10/2017 | McConnell et al. |
| 2017/0306710 | A1 | 10/2017 | Trydal et al. |
| 2017/0328160 | A1 | 11/2017 | Arnaly |
| 2017/0357021 | A1 | 12/2017 | Valero et al. |
| 2018/0002999 | A1 | 1/2018 | Johnson |
| 2018/0003038 | A1 | 1/2018 | Cherewyk |
| 2018/0003045 | A1 | 1/2018 | Dotson et al. |
| 2018/0030334 | A1 | 2/2018 | Collier et al. |
| 2018/0038208 | A1 | 2/2018 | Eitschberger et al. |
| 2018/0080298 | A1 | 3/2018 | Covalt et al. |
| 2018/0087330 | A1 | 3/2018 | Bradley et al. |
| 2018/0087369 | A1 | 3/2018 | Sherman et al. |
| 2018/0106121 | A1 | 4/2018 | Griffin et al. |
| 2018/0119529 | A1 | 5/2018 | Goyeneche |
| 2018/0156029 | A1 | 6/2018 | Harrison et al. |
| 2018/0202248 | A1 | 7/2018 | Harrington et al. |
| 2018/0202789 | A1 | 7/2018 | Parks et al. |
| 2018/0202790 | A1 | 7/2018 | Parks et al. |
| 2018/0209250 | A1 | 7/2018 | Daly et al. |
| 2018/0209251 | A1 | 7/2018 | Robey et al. |
| 2018/0252054 | A1 | 9/2018 | Stokes |
| 2018/0252507 | A1 | 9/2018 | Collier |
| 2018/0274342 | A1 | 9/2018 | Sites |
| 2018/0299239 | A1 | 10/2018 | Eitschberger et al. |
| 2018/0306010 | A1 | 10/2018 | Von Kaenel et al. |
| 2018/0313182 | A1 | 11/2018 | Cherewyk et al. |
| 2018/0318770 | A1 | 11/2018 | Eitschberger et al. |
| 2018/0340412 | A1 | 11/2018 | Singh et al. |
| 2018/0347324 | A1 | 12/2018 | Langford et al. |
| 2018/0355674 | A1 | 12/2018 | Cooper et al. |
| 2019/0031307 | A1 | 1/2019 | Siersdorfer |
| 2019/0032470 | A1 | 1/2019 | Harrigan |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0085685 | A1 | 3/2019 | McBride |
| 2019/0128657 | A1 | 5/2019 | Harrington et al. |
| 2019/0136673 | A1 | 5/2019 | Sullivan et al. |
| 2019/0153827 | A1 | 5/2019 | Goyeneche |
| 2019/0162055 | A1 | 5/2019 | Collins et al. |
| 2019/0162056 | A1 | 5/2019 | Sansing |
| 2019/0162057 | A1 | 5/2019 | Montoya Ashton et al. |
| 2019/0186211 | A1 | 6/2019 | Gonzalez |
| 2019/0195054 | A1 | 6/2019 | Bradley et al. |
| 2019/0211655 | A1 | 7/2019 | Bradley et al. |
| 2019/0218880 | A1 | 7/2019 | Cannon et al. |
| 2019/0219375 | A1 | 7/2019 | Parks et al. |
| 2019/0234188 | A1 | 8/2019 | Goyeneche |
| 2019/0242222 | A1 | 8/2019 | Eitschberger |
| 2019/0257158 | A1 | 8/2019 | Langford et al. |
| 2019/0264548 | A1 | 8/2019 | Zhao et al. |
| 2019/0277103 | A1 | 9/2019 | Wells et al. |
| 2019/0284889 | A1 | 9/2019 | LaGrange et al. |
| 2019/0292887 | A1 | 9/2019 | Austin et al. |
| 2019/0309606 | A1 | 10/2019 | Loehken et al. |
| 2019/0316449 | A1 | 10/2019 | Schultz et al. |
| 2019/0330947 | A1 | 10/2019 | Mulhern et al. |
| 2019/0330961 | A1 | 10/2019 | Knight et al. |
| 2019/0338606 | A1 | 11/2019 | Metcalf et al. |
| 2019/0338612 | A1 | 11/2019 | Holodnak et al. |
| 2019/0353015 | A1 | 11/2019 | LaGrange et al. |
| 2019/0366272 | A1 | 12/2019 | Eitschberger et al. |
| 2019/0368293 | A1 | 12/2019 | Covalt et al. |
| 2019/0368301 | A1 | 12/2019 | Eitschberger et al. |
| 2019/0368319 | A1 | 12/2019 | Collins et al. |
| 2020/0018132 | A1 | 1/2020 | Ham |
| 2020/0024934 | A1 | 1/2020 | Eitschberger et al. |
| 2020/0024935 | A1 | 1/2020 | Eitschberger et al. |
| 2020/0032626 | A1 | 1/2020 | Parks et al. |
| 2020/0048996 | A1 | 2/2020 | Anthony et al. |
| 2020/0063553 | A1 | 2/2020 | Zemla et al. |
| 2020/0072029 | A1 | 3/2020 | Anthony et al. |
| 2020/0088011 | A1 | 3/2020 | Eitschberger et al. |
| 2020/0157924 | A1 | 5/2020 | Melhus et al. |
| 2020/0182025 | A1 | 6/2020 | Brady |
| 2020/0199983 | A1 | 6/2020 | Preiss et al. |
| 2020/0217635 | A1 | 7/2020 | Eitschberger |
| 2020/0248535 | A1 | 8/2020 | Goyeneche |
| 2020/0248536 | A1 | 8/2020 | Holodnak et al. |
| 2020/0256166 | A1 | 8/2020 | Knight et al. |
| 2020/0256168 | A1 | 8/2020 | Knight et al. |
| 2020/0284104 | A1 | 9/2020 | Holmberg et al. |
| 2020/0300067 | A1 | 9/2020 | Mcnelis et al. |
| 2020/0332630 | A1 | 10/2020 | Davis et al. |
| 2020/0399995 | A1 | 12/2020 | Preiss et al. |
| 2021/0238966 | A1 | 8/2021 | Preiss et al. |
| 2021/0277752 | A1 | 9/2021 | Eitschberger |

FOREIGN PATENT DOCUMENTS

| | | | |
|---|---|---|---|
| CA | 2821506 | A1 | 1/2015 |
| CA | 2941648 | A1 | 9/2015 |
| CA | 2848060 | A1 | 10/2015 |
| CA | 3040116 | A1 | 10/2016 |
| CA | 3022946 | A1 | 11/2017 |
| CA | 3021913 | A1 | 2/2018 |
| CA | 3050712 | A1 | 7/2018 |
| CA | 2980935 | C | 11/2019 |
| CA | 2821506 | C | 3/2020 |
| CN | 85107897 | A | 9/1986 |
| CN | 2821154 | | 9/2006 |
| CN | 201184775 | | 1/2009 |
| CN | 101397890 | A | 4/2009 |
| CN | 101435829 | A | 5/2009 |
| CN | 201428439 | | 3/2010 |

(56) References Cited

FOREIGN PATENT DOCUMENTS

| | | | |
|---|---|---|---|
| CN | 101691837 | B | 4/2010 |
| CN | 201507296 | U | 6/2010 |
| CN | 201546707 | U | 8/2010 |
| CN | 101892822 | B | 11/2010 |
| CN | 201620848 | U | 11/2010 |
| CN | 202431259 | U | 9/2012 |
| CN | 103485750 | A | 1/2014 |
| CN | 103993861 | A | 8/2014 |
| CN | 204430910 | U | 7/2015 |
| CN | 207847603 | U | 9/2018 |
| CN | 208347755 | U | 1/2019 |
| CN | 208870580 | U | 5/2019 |
| CN | 209195374 | U | 8/2019 |
| CN | 209780779 | U | 12/2019 |
| CN | 209908471 | U | 1/2020 |
| CN | 214836284 | U | 11/2021 |
| DE | 10344523 | A1 | 4/2005 |
| DE | 102007007498 | | 10/2015 |
| RU | 2633904 | C1 | 10/2017 |
| WO | 2001004452 | A1 | 1/2001 |
| WO | 0133029 | A3 | 5/2001 |
| WO | 0159401 | A1 | 8/2001 |
| WO | 2001059401 | A1 | 8/2001 |
| WO | 2005103602 | A2 | 11/2005 |
| WO | 2009091422 | A2 | 7/2009 |
| WO | 2010104634 | A2 | 9/2010 |
| WO | 2011051435 | A2 | 5/2011 |
| WO | 2011150251 | A1 | 12/2011 |
| WO | 2012006357 | A2 | 1/2012 |
| WO | 2012140102 | A1 | 10/2012 |
| WO | 2012161854 | A2 | 11/2012 |
| WO | 2014179689 | A1 | 11/2014 |
| WO | 2015006869 | A1 | 1/2015 |
| WO | 2015028204 | A2 | 3/2015 |
| WO | 2015028204 | A3 | 3/2015 |
| WO | 2015081092 | A2 | 6/2015 |
| WO | 2015081092 | A3 | 8/2015 |
| WO | 2015134719 | A1 | 9/2015 |
| WO | 2015196095 | A1 | 12/2015 |
| WO | 2017029240 | A1 | 2/2017 |
| WO | 2017147329 | A1 | 8/2017 |
| WO | 2018009223 | A1 | 1/2018 |
| WO | 2018067598 | A1 | 4/2018 |
| WO | 2018094220 | A1 | 5/2018 |
| WO | 2018136808 | A1 | 7/2018 |
| WO | 2018177733 | A1 | 10/2018 |
| WO | 2018182565 | A1 | 10/2018 |
| WO | 2018213768 | A1 | 11/2018 |
| WO | 2018231847 | A1 | 12/2018 |
| WO | 2018234013 | A1 | 12/2018 |
| WO | 2019098991 | A1 | 5/2019 |
| WO | 2019117861 | A1 | 6/2019 |
| WO | 2019117874 | A1 | 6/2019 |
| WO | 2019147294 | A1 | 8/2019 |
| WO | 2019148009 | A2 | 8/2019 |
| WO | 2019165286 | A1 | 8/2019 |
| WO | 2019180462 | A1 | 9/2019 |
| WO | 2019204137 | A1 | 10/2019 |
| WO | 2019229520 | A1 | 12/2019 |
| WO | 2019229521 | A1 | 12/2019 |
| WO | 2019238410 | A1 | 12/2019 |
| WO | 2020002383 | A1 | 1/2020 |
| WO | 2020002983 | A1 | 1/2020 |
| WO | 2020035616 | A1 | 2/2020 |
| WO | 2020112983 | A1 | 6/2020 |
| WO | 2020200935 | A1 | 10/2020 |
| WO | 2020232242 | A1 | 11/2020 |
| WO | 2021025716 | A1 | 2/2021 |
| WO | 2021116336 | A1 | 6/2021 |
| WO | 2021116338 | A1 | 6/2021 |
| WO | 2021122797 | A1 | 6/2021 |
| WO | 2022184654 | A1 | 9/2022 |
| WO | 2022184731 | A1 | 9/2022 |

OTHER PUBLICATIONS

Dynaenergetics, Selection Perforating Switch, Product Information Sheet, May 27, 2011, 1 pg.

Dynaenergetics, Electronic Top Fire Detonator, Product Information Sheet, Jul. 30, 2013 1 pg.

German Patent Office, Office Action dated May 22, 2014, in German: See Office Action for German Patent Application No. 10 2013 109 227.6, which is in the same family as PCT Application No. PCT/EP2014/065752, 8 pgs.

PCT Search Report and Written Opinion, mailed May 4, 2015: See Search Report and Written opinion for PCT Application No. PCT/EP2014/065752, 12 pgs.

SIPO, Search Report dated Mar. 29, 2017, in Chinese: See Search Report for CN App. No. 201480040456.9, which is in the same family as PCT App. No. PCT/CA2014/050673, 12 & 3 pgs.

Jim Gilliat/Kaled Gasmi, New Select-Fire System, Baker Hughes, Presentation—2013 Asia-Pacific Perforating Symposium, Apr. 29, 2013, 16 pgs., http://www.perforators.org/presentations.php.

Dynaenergetics, DYNAselect Electronic Detonator 0015 SFDE RDX 1.4S, Product Information, Dec. 16, 2011, 1 pg.

Dynaenergetics, DYNAselect Electronic Detonator 0015 SFDE RDX 1.4B, Product Information, Dec. 16, 2011, 1 pg.

Norwegian Industrial Property Office, Office Action for NO Patent App. No. 20171759, dated Jan. 14, 2020, 4 pgs.

Norwegian Industrial Property Office, Search Report for NO Patent App. No. 20171759, dated Jan. 14, 2020, 2 pgs.

International Search Report and Written Opinion of International App. No. PCT/EP2019/072064, mailed Nov. 20, 2019, 15 ogs.

Halliburton, Halliburton Velocity™ Aligned Gun SysteM, Economic, Compact, And Versatile System For Orienting Perforations In Horizontal Wells, 2022, 2 pgs., www.halliburton.com.

Dynaenergetics GmbH & Co. KG, Patent Owner's Response to Hunting Titan's Petition for Inter Parties Review—Case IPR2018-00600, filed Dec. 6, 2018, 73 pages.

International Searching Authority; International Search Report and Written Opinion of the International Searching Authority for PCT/EP2020/086496; mailed on Apr. 7, 2021; 10 pages.

International Searching Authority; International Search Report and Written Opinion of the International Searching Authority for PCT/EP2022/055014; mailed on Jul. 4, 2022; 17 pages.

International Searching Authority; International Search Report and Written Opinion of the International Searching Authority for PCT/EP2022/055191; mailed on May 20, 2022; 10 pages.

Thilo Scharf; "DynaEnergetics exhibition and product briefing"; pp. 5-6; presented at 2014 Offshore Technology Conference; May 2014.

Thilo Scharf; "DynaStage & BTM Introduction"; pp. 4-5, 9; presented at 2014 Offshore Technology Conference; May 2014.

United States Patent and Trademark Office; Notice of Allowance for U.S. Appl. No. 17/123,972; dated Jun. 20, 2022; 8 pages.

United States Patent and Trademark Office; Notice of Allowance issued for U.S. Appl. No. 18/166,849 on Nov. 1, 2024, 8 pages.

* cited by examiner

MANUALLY ORIENTED INTERNAL SHAPED CHARGE ALIGNMENT SYSTEM AND METHOD OF USE

CROSS-REFERENCE TO RELATED APPLICATIONS

This application claims the benefit of U.S. Provisional Patent Application No. 63/292,703 filed Dec. 22, 2021 and U.S. Provisional Patent Application No. 63/340,016 filed May 10, 2022, the entire contents of which are incorporated herein by reference.

BACKGROUND

Hydrocarbon extraction may include inserting a gun string or tool string into a wellbore for perforation operations. Perforating guns, or other tools used for hydrocarbon extraction, may be housed in tool segments, housings, or bodies, which are connected to adjacent tools, connectors, or sub assemblies, to form the tool string. Some perforation operations require a specific alignment of independent tool string components relative to one another, to perforate in a specific direction. For example, an operator may need to align the firing direction of shaped charges housed in multiple perforating guns within a tool string to confirm that the perforating guns are fired uniformly on a desired plane or at a desired degree within the wellbore.

In the manufacturing and/or assembly process of perforating gun assemblies making up a tool string, alignment of components in one perforating gun assembly with components in another perforating gun assembly is not guaranteed due to tightening or torquing of the gun housing of each perforating gun assembly with each other. Hardware alignment components, such as threaded alignment collars that are coupled to gun housing ends, and external orienting systems, may be used to align a second perforating gun relative to a first perforating gun in the tool string. External alignment components may be specially designed to engage the outer profile of a particular gun housing or connection, which may limit a user's ability to use a single alignment component to align gun housings of different sizes.

FIG. 1 and FIG. 2 show an external alignment system 102 and hardware for a perforating gun tool string according to the prior art. The external alignment system 102 includes an alignment ring 104 provided on a first end portion 106 of a perforating gun housing 108. The alignment ring 104 is secured in place with a retention ring 110 threaded onto the first end portion 106 of the perforating gun housing 108. The alignment ring 104 has a screw socket 112 to receive a screw for aligning the alignment ring 104 and perforating gun housing 108 with an adjacent gun housing. A retention collar 114 is coupled to the perforating gun housing 108 on an interior surface of the end portion 106, and retains a bulkhead 116 in the perforating gun housing 108. Seal elements 118 seal the perforating gun housing 108 with the alignment ring 104 and to prevent wellbore fluid from the outside environment from entering the perforating gun housing 108.

With reference to FIG. 2, a sub assembly 202 having a first sub component 204 and a second sub component 206 is used to connect adjacent gun housings in a tool string and align said gun housings via manual alignment of external alignment apertures 208 provided on the connecting portion of each of the first sub component 204 and second sub component 206.

It may be desirable to develop a manual internal alignment system for a perforating gun or tool component in a tool string that simplifies operator use and reduces manufacturing costs. It may be desirable to develop an internal alignment system with a universal fit for use with any known gun housing type.

BRIEF SUMMARY

According to an aspect, the exemplary embodiments include a shaped charge orientation system. The system may include a tool string comprising a first perforating gun housing having a first hollow interior and a second perforating gun housing having a second hollow interior. A first shaped charge holder may be positioned in the first hollow interior and oriented in a first direction. A second shaped charge holder may be positioned in the second hollow interior and oriented in a second direction that is different than the first direction. A manual alignment tool including an alignment tool handle extending from an alignment tool body may engage with a structure in the second hollow interior to rotate the second shaped charge holder from the second direction to the first direction.

According to an aspect, the exemplary embodiments may include a method of manually aligning a first shaped charge holder in a first perforating gun housing with a second shaped charge holder in a second perforating gun housing. The method may include positioning the first shaped charge holder in a first direction in the first perforating gun. The first perforating gun may include a first perforating gun housing first end (a first housing end) and a first perforating gun housing second end (a second housing end). The method may include marking an outer surface of the first perforating gun housing with a visual indicator in alignment with the first direction. The method may include positioning the second shaped charge holder in the second perforating gun. The second perforating gun may have a second perforating gun housing first end (a first housing end) and a second perforating gun housing second end (second housing end). The method may include connecting the first perforating gun housing to the second perforating gun housing. According to an aspect, the method further includes orienting the second shaped charge holder into an alignment that is relative to the first shaped charge holder, wherein the alignment is in the first direction. Orienting of the second shaped charge holder may include rotating the second shaped charge holder independently of the second perforating gun using a manual alignment tool.

According to an aspect, the exemplary embodiments may include a perforating gun alignment assembly. The assembly may include a perforating gun housing having a housing first end and a housing second end, an inner surface defining a hollow interior, and an outer surface. At least one shaped charge holder is provided in the hollow interior and may be configured to house a shaped charge. A conductive end connector may be coupled to the shaped charge holder and engaged with a bulkhead provided adjacent to the hollow interior. A detonator holder may be coupled to the shaped charge holder. A centralizer including a centralizer ring may be engaged with the inner surface of the perforating gun housing and the detonator holder may be retained in the centralizer. The shaped charge holder, the detonator holder, and the centralizer may be together configured to be rotated relative to the perforating gun housing.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
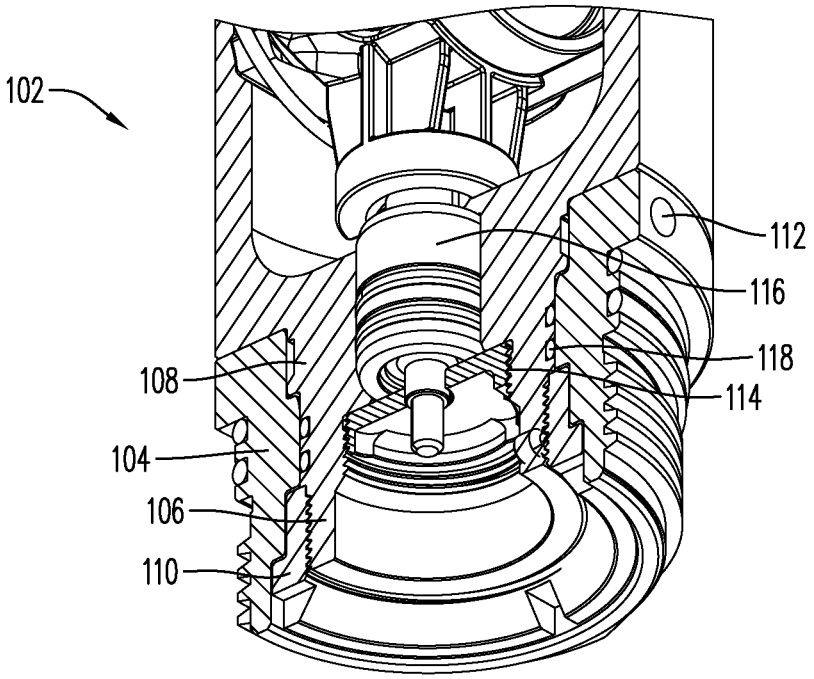
FIG. 1 is a cross-sectional view of an external alignment assembly according to the prior art.
Figure 2:
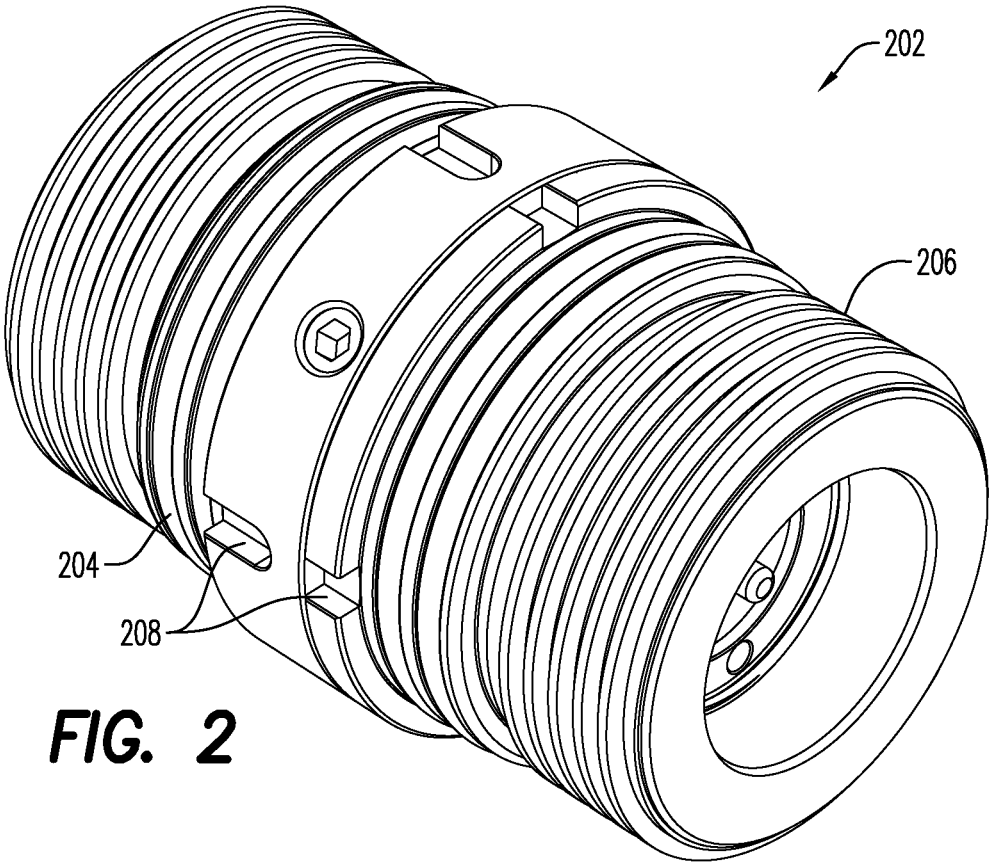
FIG. 2 illustrates an aspect of the subject matter in accordance with an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, the phrases "devices," "systems," and "methods" may be used either individually or in any combination referring without limitation to disclosed components, grouping, arrangements, steps, functions, or processes.

Figure 3A:
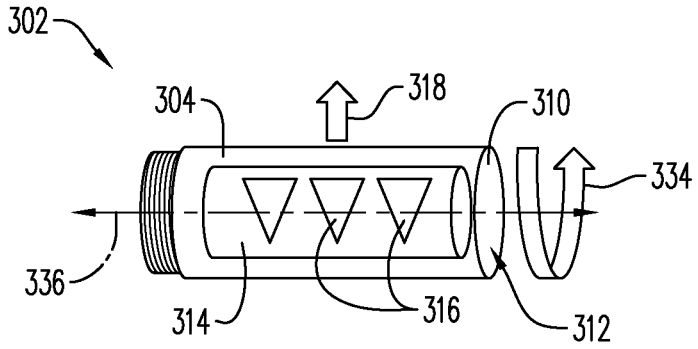
FIG. 3A is a schematic side view of a first perforating gun housing and shaped charge holder according to an exemplary embodiment.

FIG. 3A shows a side view of a perforating gun 302 according to an exemplary embodiment. The perforating gun 302 may include a perforating gun housing 304 having a housing first end 306 and a housing second end 310 spaced apart from and opposite to the housing first end 306. The perforating gun housing 304 may include a housing interior 312 with a shaped charge holder 314 positioned within the housing interior 312. The shaped charge holder 314 may house one or more shaped charges 316. The shaped charge holder 314 and shaped charges 316 housed therein may be oriented in a first direction 318 such that a firing path of the shaped charges 316 will extend along a path defined by the first direction 318. In an aspect, the first direction 318 may be a desired direction for the firing path of the shaped charges, for example zero degrees. Orientation of the shaped charges 316 in the first direction 318 may be accomplished by rotating the perforating gun housing 304 and its contents, including the shaped charge holder 314 and shaped charges 316 (as indicated by arrow 334), about a central axis 336 of the perforating gun housing 304.

Figure 3B:
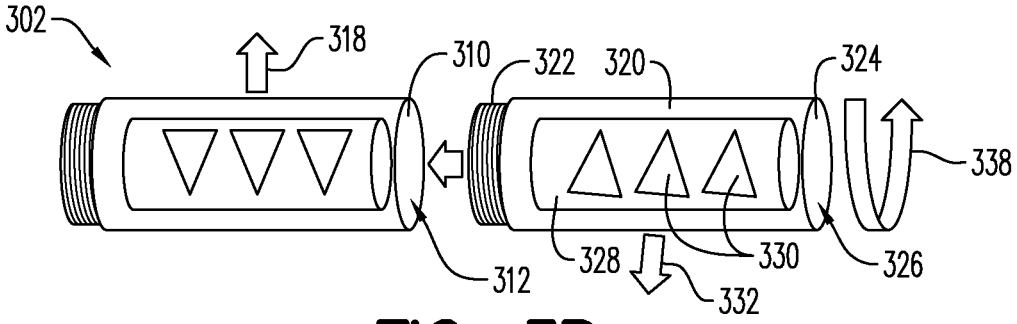
FIG. 3B is a schematic side view of the first perforating gun housing and shaped charge holder of FIG. 3A and a second perforating gun housing and shaped charge holder according to an exemplary embodiment, in a disassembled configuration.

In FIG. 3B, a second perforating gun housing 320 may be connected to the first perforating gun housing 304. The second perforating gun housing 320 may include a housing first end 322, a housing second end 324 opposite the housing first end 322, a housing interior 326 housing a shaped charge holder 328 and shaped charges 330. The second perforating gun housing 320 may be coupled to the first perforating gun housing 304 by inserting the housing first end 322 of the second perforating gun housing 320 into the housing interior 312 of the first perforating gun housing 304 and connecting the housing first end 322 of the second perforating gun housing 320 to the housing second end 310 of the first perforating gun housing 304, for example, with a threaded connection. Coupling of the first perforating gun housing 304 to the second perforating gun housing 320 may be accomplished by inserting the housing first end 322 of the second perforating gun housing 320 into the housing interior 312 of the first perforating gun housing 304 and rotating the second perforating gun housing 320 relative to the first perforating gun housing 304 (as indicated by arrow 338).

The shaped charge holder 328 and shaped charges 330 of the second perforating gun housing 320 may be oriented in a second direction 332 that is different than the first direction 318.

Figure 3C:
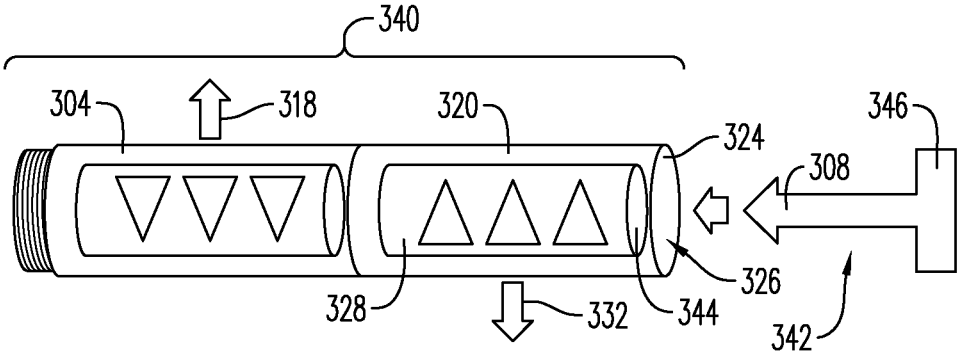
FIG. 3C is a schematic side view of a tool string including the first perforating gun housing and shaped charge holder and the second perforating gun housing and shaped charge holder of FIG. 3B, according to an exemplary embodiment.

With reference to FIG. 3C, a tool string 340 may be provided including the coupled first perforating gun housing 304 and second perforating gun housing 320. The coupling and torquing up (illustrated in FIG. 3B) of the second perforating gun housing 320 to the first perforating gun housing 304 may result in the shaped charges 316 of the second perforating gun 302 being oriented in a random, undesired direction (i.e., in the second direction 332). The shaped charges 316 of the second perforating gun 302 may be oriented such that a firing path of the shaped charges 316 of the second perforating gun 302 will extend along a path defined by the second direction 332. In an aspect, the second direction 332 may be any direction that is different than the first direction 318.

In an aspect, orientation of the shaped charge holder 328 and shaped charges 330 of the second perforating gun housing 320 may be accomplished through use of hardware components and an alignment system as described herein. A manual alignment tool 342 may be inserted into the housing interior 326 of the second perforating gun housing 320 to orient the shaped charge holder 328 to a desired firing path direction (i.e., from the second direction 332 to the first direction 318). The manual alignment tool 342 may include an alignment tool engagement portion 308 and an alignment tool handle 346. The alignment tool engagement portion 308 may be inserted through the housing second end 324 and into the housing interior 326 of the second perforating gun housing 320, to engage a charge holder engagement portion 344 of the second shaped charge holder 328.

Figure 3D:
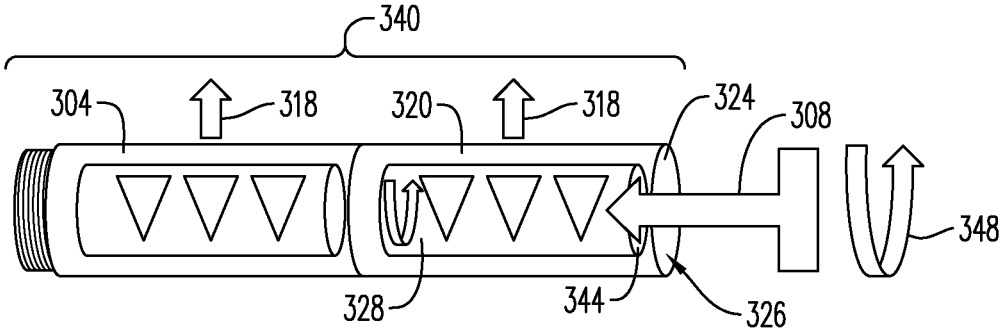
FIG. 3D is a schematic side view of the tool string of FIG. 3C in an assembled and aligned configuration, according to an exemplary embodiment.

In FIG. 3D, alignment of the shaped charges 330 of the second perforating gun housing 320 with the shaped charges 316 of the first perforating gun housing 304 (i.e., in the first direction 318) after connecting the first perforating gun housing 304 to the second perforating gun housing 320 may be accomplished by rotating the shaped charge holder 328 of the second perforating gun housing 320 inside the second perforating gun housing 320, independently from each of the first perforating gun housing 304 and the second perforating gun housing 320 (indicated by arrow 348). In an exemplary embodiment, the shaped charge holder 328 may be rotated internally by hand, or by using the manual alignment tool 342 as described hereinabove, to provide rotation of the shaped charge holder 328 relative to the second perforating gun housing 320. In an aspect, the orienting of the second shaped charge holder 328 may be achieved without the use of a self-orienting device, such as a bearing, swivel, gravitational force, or an eccentric weight distribution.

Once the shaped charges 330 are in the desired alignment position (i.e., oriented in the first direction 318), the shaped charge holder 328 may be fixed or locked in position. The shaped charge holder 328 may be retained in position by frictional engagement with an interior surface of the perforating gun housing 320 or with an intermediary or connecting structure, or by a clamping, locking, or anchoring mechanism that is provided on, in contact with, or coupled to a structure or surface of the perforating gun housing 320. Such intermediary or connecting structure may include, for example, a projecting structure or key that extends from the shaped charge holder or another mechanism that is connected to the shaped charge holder.

Figure 4A:
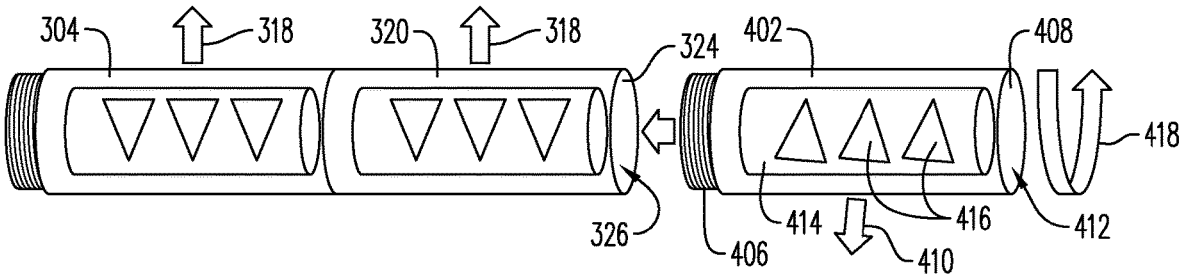
FIG. 4A is a schematic side view of the tool string of FIG. 3B and a third perforating gun housing and shaped charge holder according to an exemplary embodiment, in a disassembled configuration.

The steps detailed above with respect to FIG. 3A, FIG. 3B, FIG. 3C, and FIG. 3D for assembling a tool string 340 and internally rotating a shaped charge holder 328 and shaped charges 316 independently of the perforating gun housing 320 may be repeated in FIG. 4A, FIG. 4B, FIG. 4C, and FIG. 4D with a third perforating gun housing 402. As shown in FIG. 4A, the third perforating gun housing 402 may include a housing first end 406, a housing second end 408 opposite the housing first end 406, and a housing interior 412 housing a shaped charge holder 414 and shaped charges 416. The third perforating gun housing 402 may be coupled to the second perforating gun housing 320 by inserting the housing first end 406 of the third perforating gun housing 402 into the housing interior 326 of the second perforating gun housing 320 and coupling the housing first end 406 of the third perforating gun housing 402 to the housing second end 324 of the second perforating gun housing 320, as described above.

Figure 4B:
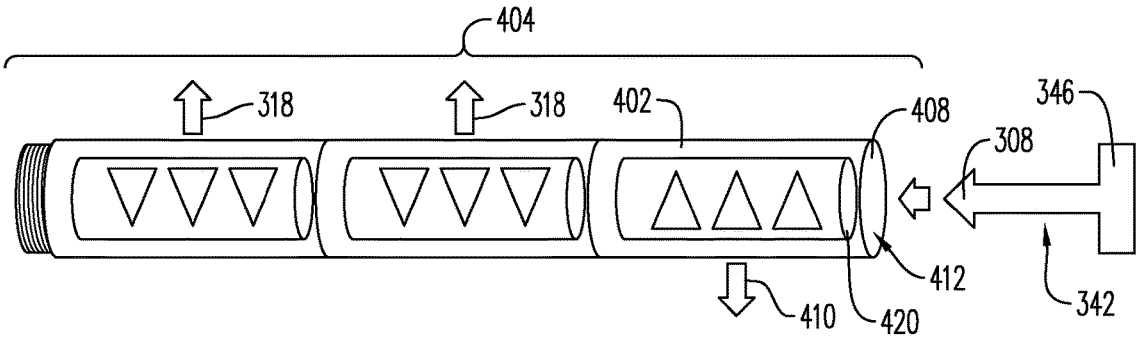
FIG. 4B is a schematic side view of a tool string including the tool string of FIG. 3D and the third perforating gun housing and shaped charge holder of FIG. 4A, according to an exemplary embodiment.

A tool string 404, shown in FIG. 4B, may include the connected first perforating gun housing 304, second perforating gun housing 320, and third perforating gun housing 402. The connection and torquing up (indicated by arrow 418) of the third perforating gun housing 402 relative to the second perforating gun housing 320 may result in the third shaped charges 416 being oriented in a random direction (i.e., third direction 410). While the random direction is shown as being generally 180-degrees from each of the first direction and the second direction, it is contemplated that the random direction may be less or more than 180-degrees from each of the first direction and the second direction. The random direction may be any direction that is other than the desired direction for the positioning or orientation of the third shaped charges 416.

Figure 4C:
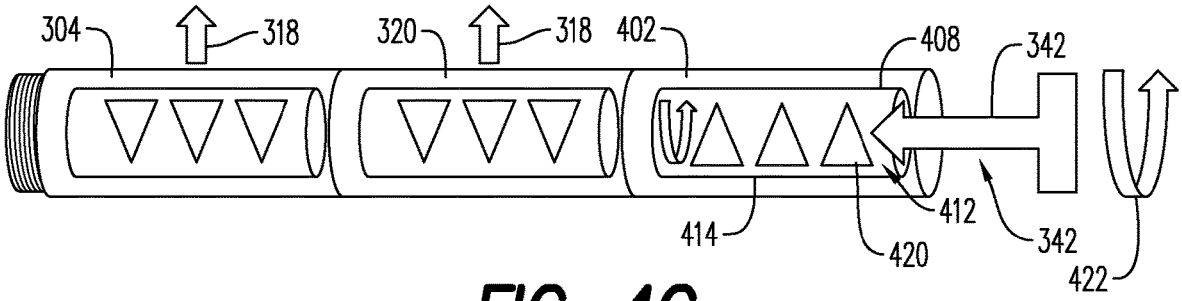
FIG. 4C is a schematic side view of a tool string including the tool string of FIG. 3D and the third perforating gun housing and shaped charge holder of FIG. 4A, according to an exemplary embodiment.

As detailed above and as illustrated in FIG. 4C, the third shaped charge holder 414 may be internally rotated (indicated by arrow 422) by hand or by engaging the manual alignment tool 342 with the charge holder engagement portion 420 to align, independently from the tool string 404 and the third perforating gun housing 402, the firing path of the shaped charges 416 from the third direction 410 to the first direction 318. After the rotation is completed and the shaped charges 316, 330, and 416, are aligned in the first direction 318, the shaped charge holder 414 of the third perforating gun housing 402 may be retained in position in the third perforating gun housing 402 in a similar manner as detailed above with respect to FIG. 3D.

Figure 4D:
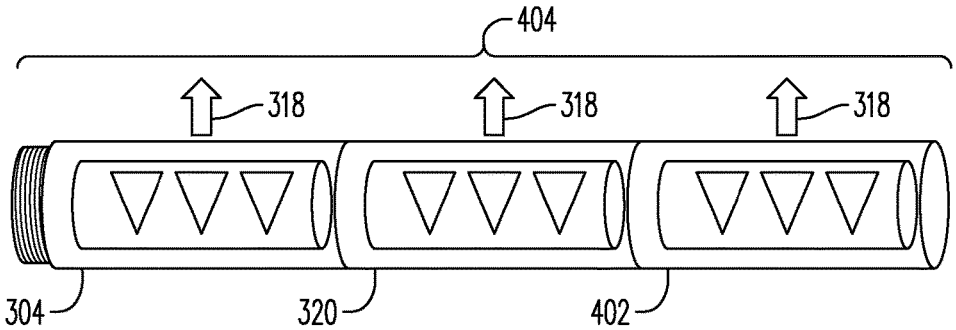
FIG. 4D is a schematic side view of the tool string of FIG. 4B and FIG. 4C in an assembled and aligned configuration, according to an exemplary embodiment.

FIG. 4D shows the tool string 404 with the three perforating gun housings 304, 320, 402, having their respective shaped charges aligned in the first direction 318.

While the shaped charge holders of FIGS. 3A-4D are illustrated as tubular structures that position multiple shaped charges in a gun housing, it is contemplated that one or more of such shaped charge holders may have any configuration that is able to hold and position one single shaped charge or multiple shaped charges in the gun housing interior. For example, non-tubular structures may be provided with one or more locations for receiving and positioning shaped charges. While a single shaped charge holder is illustrated as being positioned in each gun housing, it is contemplated that multiple shaped charge holders, connected to each other in tandem, may be provided in a single gun housing. The shaped charge holders may be formed from metal, plastic, or cardboard. The shaped charge holders, either singularly or as multiples, may be formed from a single material. For example, they may be 3-D printed, injection molded, or be formed from a single plastic bar stock as unibody and monolithic structures.

Figure 5:
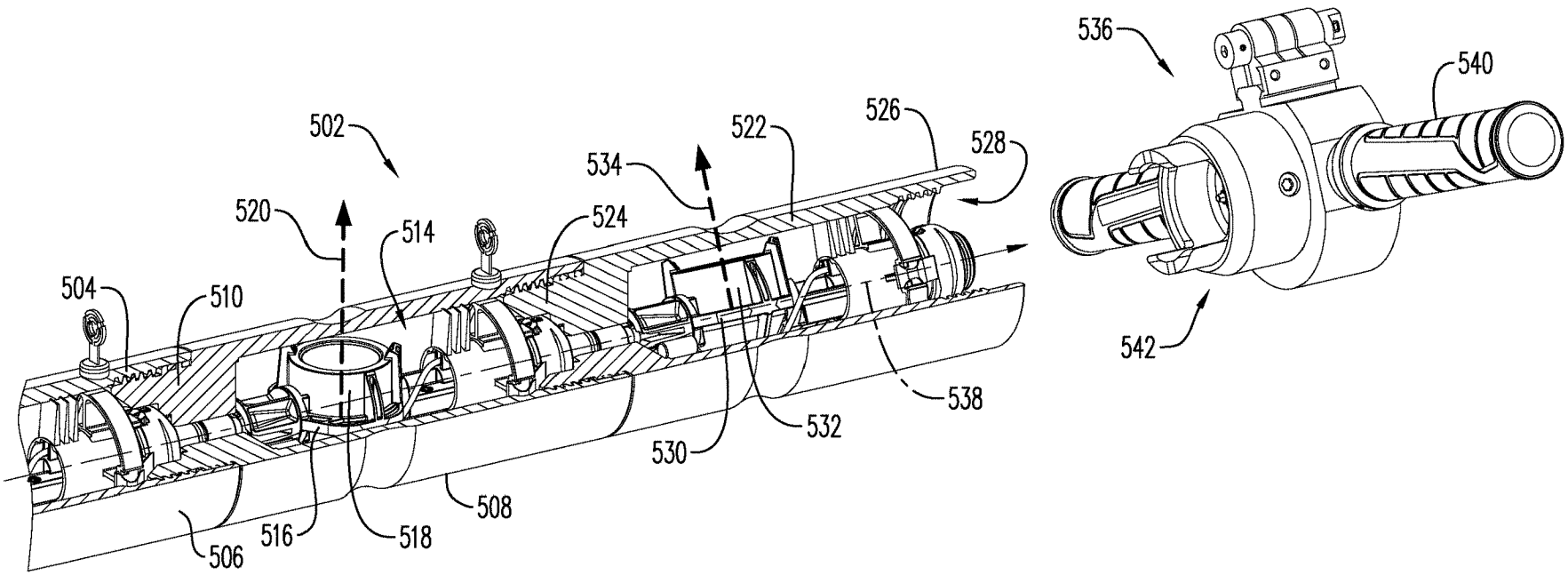
FIG. 5 illustrates a tool string and a manual alignment tool, according to an exemplary embodiment.

FIG. 5 shows an exemplary embodiment of a tool string 502 and a manual alignment tool 536. The tool string 502 may include a plurality of perforating gun housings 504, 508, 522 coupled together. In an aspect, the perforating gun housing 504, 508, 522 may be coupled to one another directly without the use of a sub assembly. For example, a housing first end 524 of the perforating gun housing 522 may be inserted into a hollow interior 514 of the perforating gun housing 508 and coupled to a housing second end 512 of the perforating gun housing 508 by corresponding mated threading. Similarly, a housing first end 510 of the perforating gun housing 508 may be coupled to a housing second end 506 of the perforating gun housing 504 by inserting the housing first end 510 into a hollow interior of the perforating gun housing 504 through the housing second end 506. While the exemplary embodiment shows direct coupling of the housings without the use of a sub assembly, it is contemplated that the tool string 502 may include a sub assembly between one or more of the gun housings.

With further reference to FIG. 5, a shaped charge holder (516 in the perforating gun housing 508 and 530 in the perforating gun housing 522) may be provided in each perforating gun housing 504, 508, 522 of the tool string 502. A first shaped charge 518 may be positioned in a first shaped charge holder 516 of the perforating gun housing 508, and a second shaped charge 532 may be positioned in a second shaped charge holder 530 of the perforating gun housing 522. The first shaped charge 518 may be oriented in a first direction 520 and the second shaped charge 532 may be oriented in a second direction 534 that is different than the first direction 520. While the exemplary embodiment shows a single shaped charge holder containing a single shaped charge in the respective gun housings, it is contemplated that one or more of the gun housings may each contain more than one shaped charge holder and/or more than one shaped charge.

The manual alignment tool 536 may be inserted into a housing second end (for example, housing second end 526 of the perforating gun housing 522) of the terminal gun housing 522 on the gun tool string 502, to engage with and rotate the shaped charge holder 530 provided in the hollow interior 528 of the terminal gun housing on the gun tool string. In an aspect, the manual alignment tool 536 may rotate the shaped charge holder 530 around a central axis (represented by line 538 in FIG. 5) extending axially through the tool string 502. Each of the tool string 502, the perforating gun housings 504, 508, 522, and the shaped charge holders 516, 530 may share a common central axis around which the shaped charge holder 516, 530 may rotate.

The manual alignment tool 536 may include an alignment tool handle 540 and an alignment tool body 542. The alignment tool body 542 may be inserted into the housing second end 526 of the perforating gun housing 522 as described in connection with FIG. 7, FIG. 8, and FIG. 9 below. Once inserted into the hollow interior 528, the alignment tool body 542 may engage with a structure in the hollow interior 528 (described in detail below with reference to FIG. 6A and FIG. 7), and an operator may then use the alignment tool handle 540 to rotate the shaped charge holder 530 from a present rotational degree (shown by arrow 534) to a desired rotational degree (for example, on a common plane with arrow 520 depicting the rotational degree of the shaped charge holder 516 of the perforating gun housing 508).

Figure 6A:
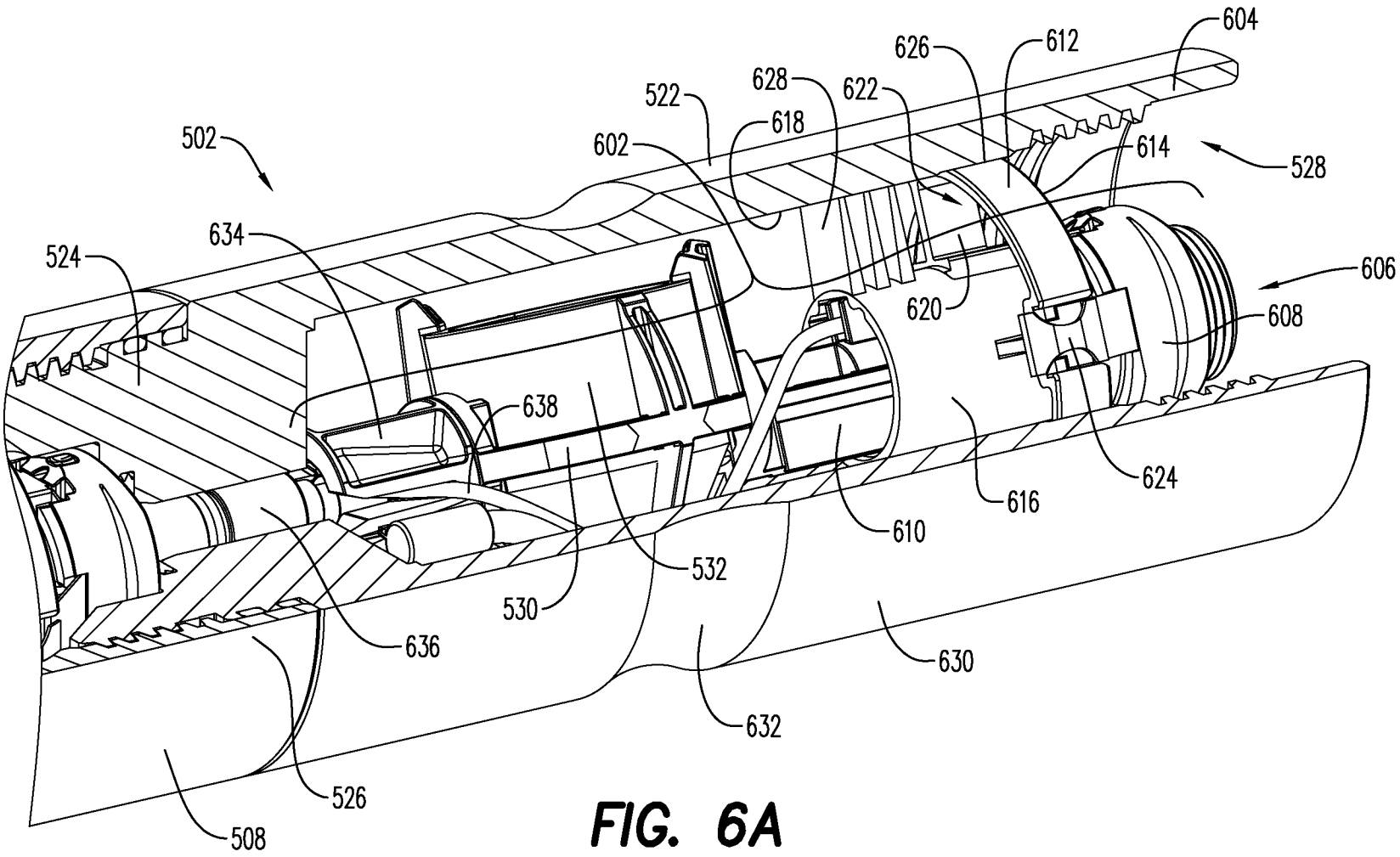
FIG. 6A is a partial cutaway view of the tool string of FIG. 5, according to an exemplary embodiment.

FIG. 6A shows a cutaway view of the terminal perforating gun housing 522 of the tool string 502 and an internal assembly 602 housed in the perforating gun housing 522 of FIG. 5 in further detail. The internal assembly 602 may be inserted into the hollow interior 528 through a housing second end 604 of the perforating gun housing 522, and may include a detonator (not shown) housed in a detonator holder 606, the shaped charge holder 530, the shaped charge 532, and a conductive end connector 634. Features and functions of the internal assembly 602 and its components may be according to those disclosed in PCT Application No. EP 2022/055014 filed Feb. 28, 2022, which is commonly owned by DynaEnergetics Europe GmbH and incorporated by reference herein, to the extent it is compatible and/or consistent with this disclosure. It is contemplated that the internal assembly 602 may include more than one shaped charge holder 530 and shaped charge 532 coupled together to form a modular shaped charge chain (not shown). In an aspect, the shaped charges provided in a shaped charge chain within a single gun housing may be oriented at a desired phasing relative to one another by rotating adjacent shaped charge holders through different positions (such as by a "clocking" rotation), such as for example, numbers arranged around a clock face corresponding respectively to different shaped charge phasing.

The detonator holder 606 may include a detonator holder cap 608 and a detonator holder stem 610. The detonator holder 606 may be retained and centralized within the hollow interior 528 of the perforating gun housing 522 by a centralizer 612. The exemplary centralizer 612 has a centralizer ring 614 encircling a centralizer body such as an axially oriented central tube 616. The central tube 616 may receive the detonator holder stem 610 so that the centralizer 612 may be slid over the detonator holder stem 610 to adjoin the detonator holder cap 608. The detonator holder stem 610 may extend from the detonator holder cap 608 along a longitudinal axis. A detonator may be housed in the detonator holder 606. An end of the detonator holder stem 610 opposite the detonator holder cap 608 may be coupled to the shaped charge holder 530.

The centralizer ring 614 may be configured to contact an inner surface 618 of the perforating gun housing 522 so that the inner surface 618 provides a barrier against the centralizer 612 to prevent the centralizer 612 from tilting or radial misalignment. The centralizer ring 614 may be connected to the central tube 616 by spokes 620, thereby forming open areas 622 when the centralizer 612 is positioned within the housing 522. One or more fins 628 may extend from the central tube 616 to contact the inner surface 618 of the perforating gun housing 522 to prevent unintentional axial movement of the detonator holder cap 608 and the internal assembly 602. In an aspect, the spoke 620 and the fin 628 may each extend radially outward in the same direction as the firing path of the shaped charge 532.

The detonator holder 606 may include a ground contact plate 624 positioned within the detonator holder cap 608 and extending therethrough to contact the inner surface 618 of the perforating gun housing 522. In an aspect, the ground contact plate 624 may be biased away from the detonator holder 606 to engage against the inner surface 618. The inner surface 618 may have a surface profile including a machined surface portion 626 that has a larger diameter relative to the surrounding inner surface area, and the ground contact plate 624 may clip into the machined surface portion 626 to secure the axial position of the internal assembly 602 in the housing interior.

A bulkhead 636 may be provided in the housing first end 524 of the terminal perforating gun housing 522. The bulkhead may help to seal the hollow interior 528 of the perforating gun housing 522 from the external wellbore environment and/or from the adjacent perforating gun housing 508. The connecting portions between adjacent perforating gun housings may include sealing members, such as o-rings to help to seal the hollow interior 528 of the perforating gun housing 522 from the external wellbore environment and/or from the adjacent perforating gun housing 508. While the exemplary embodiment shows the perforating gun housing 522 as a unibody, monolithic structure having female and male ends, it is contemplated that the bulkhead 636 may be positioned in a sub or tandem seal adapter that is provided between and coupled to adjacent perforating gun housings. The conductive end connector 634 may receive an electrical contact of the bulkhead 636 and connect to a first end of a signal relay wire 638. The signal relay wire 638 may be connected at a second end to an electrical contact provided on the detonator holder 606.

A banded scallop 632 may be provided circumferentially around an outer surface 630 of the perforating gun housing 522. The banded scallop 632 may be a portion of the gun housing wall having a reduced wall thickness, which is in radial alignment with the firing path of the shaped charge 532. The banded scallop 632 may be a depression that is formed into the outer surface 630 of the perforating gun housing 522.

Figure 6B:
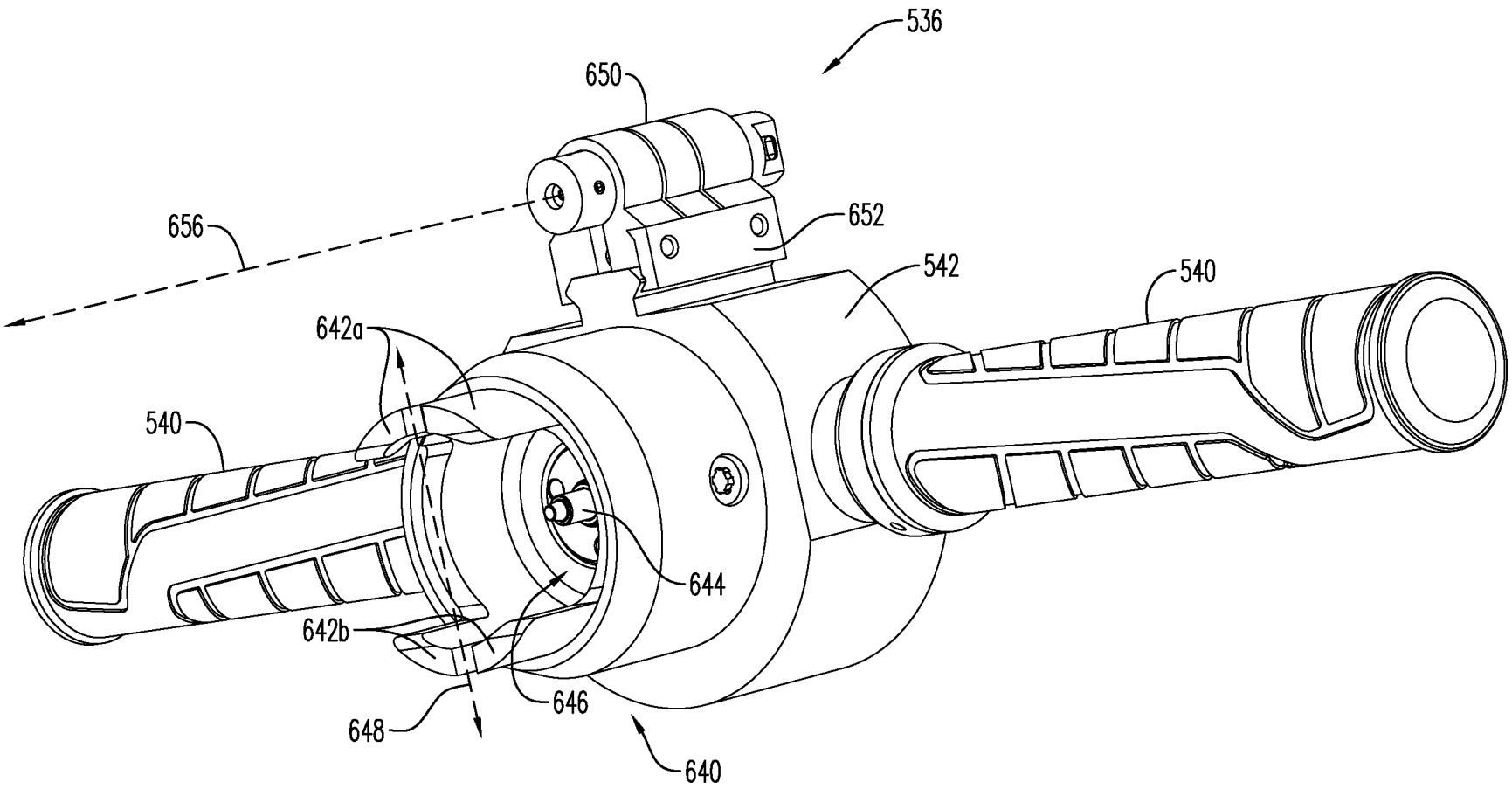
FIG. 6B is a perspective view of the manual alignment tool of FIG. 5, according to an exemplary embodiment.

With reference to FIG. 6B, the manual alignment tool 536 includes the alignment tool body 542, from which alignment tool handles 540 extend. The alignment tool handles 540 may be connected to or otherwise extend from the alignment tool body 542. The alignment tool handle 540 may be spaced apart from each other equidistantly around the alignment tool body 542. The manual alignment tool 536 further includes an alignment tool engagement portion 640 that is connected to the alignment tool body 542. According to an aspect, a portion of the alignment tool engagement portion 640 is circumferential disposed around a portion of the alignment tool body 542.

The alignment tool engagement portion 640 may include one or more pairs of engagement projections 642*a*, 642*b* extending from the alignment tool body 542. An engagement projection channel 648 may be provided between the pair of projections. An engagement recess 646 may be formed extending inward into the alignment tool body 542. The engagement recess 646 may be bound by a surface of the alignment tool body 542 on which an engagement contact pin 644 is provided. The engagement contact pin 644 may provide electrical connection between an electrical contact on the detonator for testing the electric al connection of the gun string or gun components, as discussed in connection with FIG. 8 below.

The manual alignment tool 536 may include a laser 650 secured on a laser mount 652 that is secured to the alignment tool body 542. In an aspect, the laser 650 and laser mount 652 may be positioned on the alignment tool body 542 so that the alignment tool handles 346 are equidistantly spaced apart from the laser 650. The laser 650 may produce a beam of light that extends in an axial direction 656. The engagement projections 642*a*, 642*b* may be positioned in radial alignment relative to the laser 650 and light beam so that a common plane (depicted by reference line 656 in the axial direction and reference line 654 in the radial direction) includes the engagement projection channels 648 and the laser 650.

Figure 7:
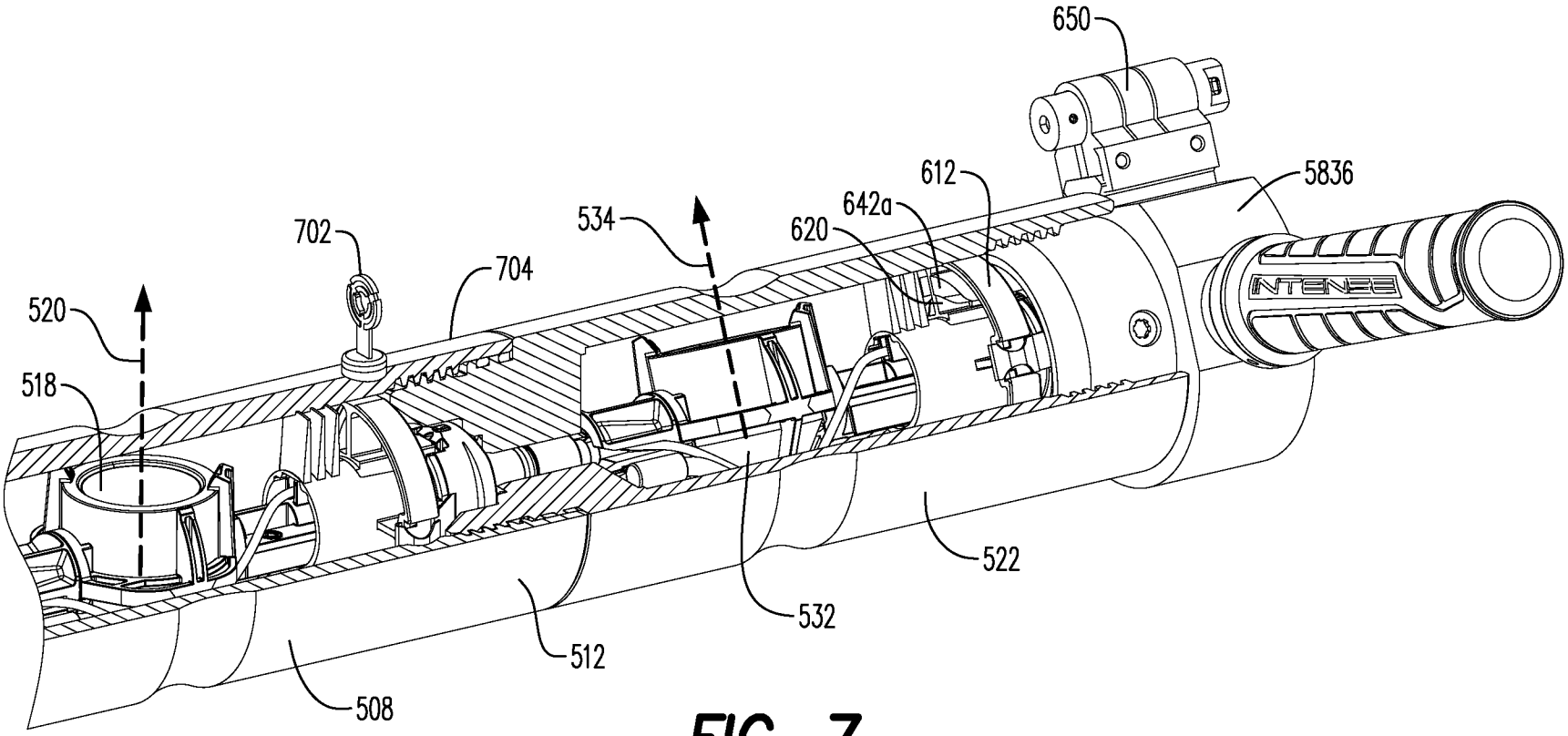
FIG. 7 is a perspective partial cutaway view of the tool string and manual alignment tool of FIG. 5 in an assembled configuration, according to an exemplary embodiment.

FIG. 7 shows the manual alignment tool 536 engaged with the tool string 502 as shown in FIG. 5, in which the shaped charge 518 of the perforating gun housing 508 is oriented in a first direction 520 and the shaped charge 532 of the perforating gun housing 522 is oriented in a second direction 534.

A marker 702 may be positioned on an outer surface 704 of the perforating gun housing 508 near the housing second end 512. The marker 702 may be radially aligned with the first direction 520 of the shaped charge 518 to provide an external visual indication of the firing path of the shaped charge 518. According to an aspect, marker 702 is configured as a tool or key that provides the external visualization. The tool or key may engage with a structure or be received in a structure on the outer surface 704 of the perforating gun housing 508.

Figure 8:
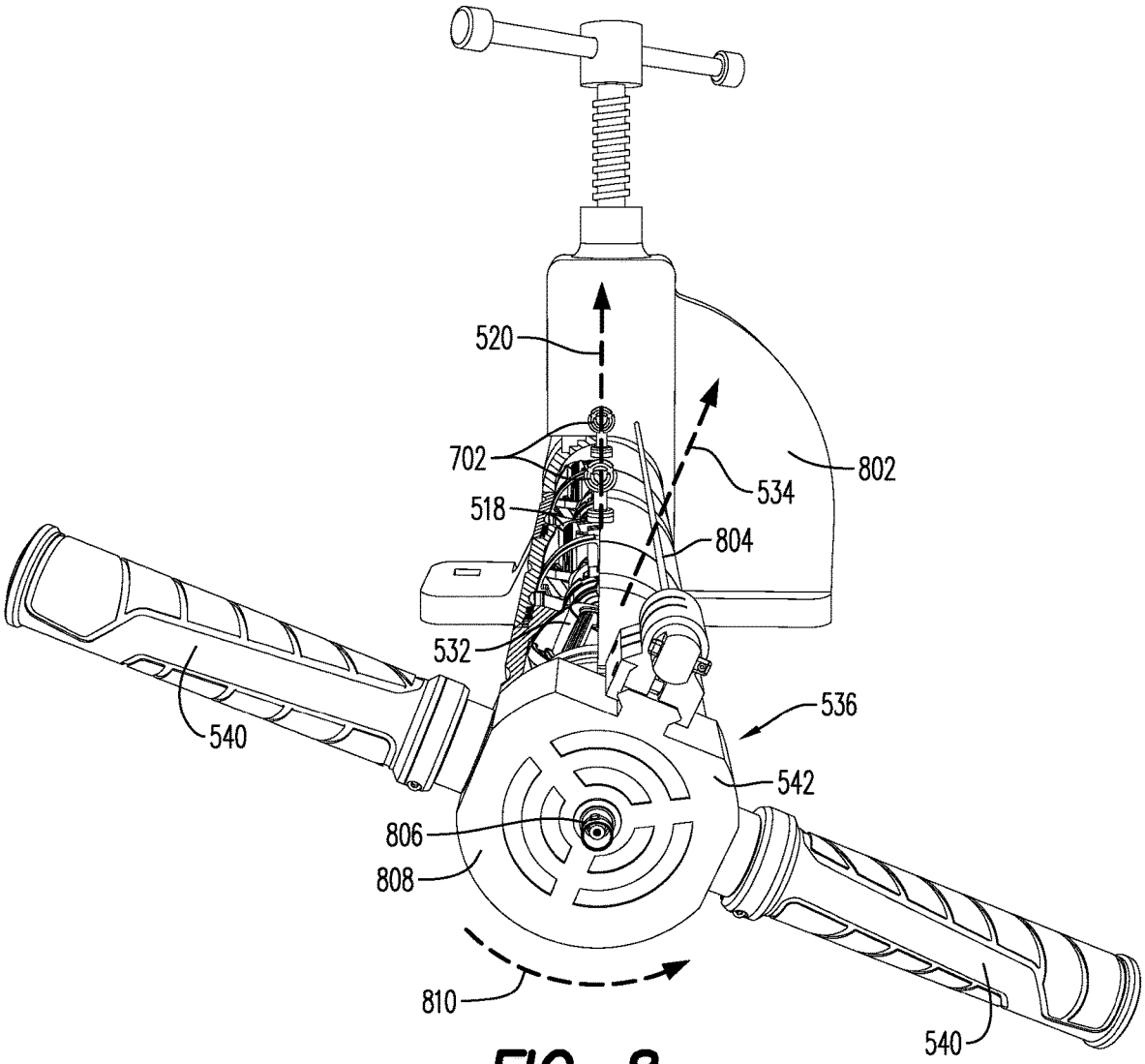
FIG. 8 is a side partial cutaway view of the tool string and manual alignment tool of FIG. 5 in an assembled configuration, according to an exemplary embodiment.

As illustrated in FIG. 8, an outer surface 808 of the alignment tool body 542 may include an external contact pin 806. The external contact pin 806 may be configured to electrically connect to testing equipment to test the electrical connections of the components (i.e., electrical components) in the tool string 502. In an aspect, the engagement contact pin 644 (FIG. 6B) may contact an electrically contactable surface of the detonator housed in the terminal gun housing, which in turn connects to the testing equipment through the external contact pin 806.

In use, the manual alignment tool 536 may be connected to the detonator holder 606 of the terminal gun housing (e.g., perforating gun housing 522). More specifically, the engagement projections 642*a*, 642*b* of the manual alignment tool 536 may be axially inserted into the respective open areas 622 of the centralizer ring 612 (FIG. 6A) to non-rotationally couple the manual alignment tool 536 to the internal assembly 602. With the manual alignment tool 536 non-rotationally coupled to the internal assembly 602, the user may move the alignment tool handles 540 to rotate the internal assembly 602 (e.g., the detonator holder, shaped charge holder, and shaped charge 532, relative to the perforating gun housing 522 in a direction 810 to align the firing path of the shaped charge 518 and the shaped charge 532 to the first direction 520. According to an aspect, the manual alignment tool 536 may be engageable with a robotic system that facilitates movement of the alignment tool handles 540 to rotate the internal assembly 602. It is contemplated that a first threshold force is required to overcome a frictional engagement between the internal housing 602 and the inner surface 618 of the perforating gun housing 522 to begin rotating the internal assembly 602 relative to the perforating gun housing 522. A second threshold force, greater than the first threshold force, may be required to overcome the threaded engagement between the first and second perforating gun housings 522, 508 such that rotation of the internal housing 602 relative to the perforating gun housing 522 does not result in the rotation of the perforating gun housing 522 relative to the perforating gun housing 508. In aspects, the direction of rotation of the internal housing 602 relative to the perforating gun housing 522 may be the same rotational direction for tightening the threaded engagement between the perforating gun housings 522, 508.

A beam 804 emitted from the laser 650 signals to the user when alignment between the shaped charges 518, 532 is achieved. Upon rotational alignment, the beam 804 will pass through the marker 702. As seen in FIG. 8, each gun housing may have an associated marker 702 provided on the exterior surface thereof to signal the orientation of the shaped charge provided within the respective gun housing. The tool string 502 may be secured in a pipe vise 802 during the assembly, torquing up, and alignment of the individual perforating gun housings.

Figure 9:
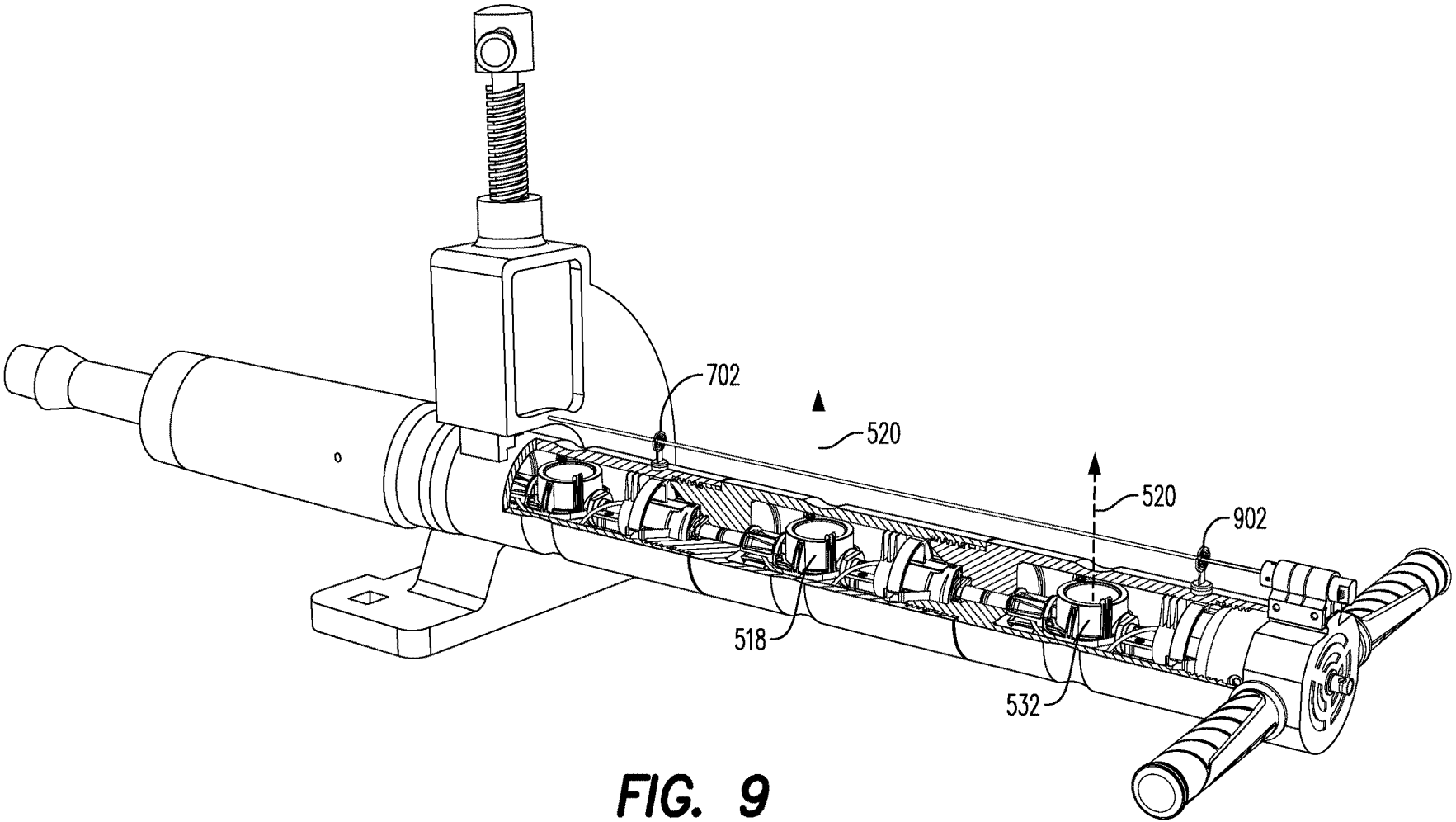
FIG. 9 is a perspective partial cutaway view of the tool string and manual alignment tool of FIG. 5 in an assembled configuration, according to an exemplary embodiment.

FIG. 9 shows the tool string 502 shown in FIG. 7 and FIG. 8, in an aligned configuration. As shown in FIG. 9, both shaped charges 518, 532 are oriented in the first direction 520. After aligning, a marker 902 may be added to the terminal gun housing. The markers 702, 902 may be magnetically coupled to the outer surface of the gun housings. Alternatively, the markers may be any type of visual indicator, including but not limited to tape, written notation, and the like.

Once the shaped charge 532 is aligned in the first direction 520, the rotational position of the shaped charge holder 530 may be secured relative to the second perforating gun housing 508. In an aspect, the shaped charge holder 530 may be secured with at least one of a frictional engagement, an anchoring mechanism, a locking mechanism, a clamping mechanism, or the like.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Approximating language, as used herein throughout the specification and claims, may be applied to modify any quantitative representation that could permissibly vary without resulting in a change in the basic function to which it is related. Accordingly, a value modified by a term such as "about" or "approximately" is not to be limited to the precise value specified. Such approximating language may refer to the specific value and/or may include a range of values that may have the same impact or effect as understood by persons of ordinary skill in the art field. For example, approximating language may include a range of +/−10%, +/−5%, or +/−3%. The term "substantially" as used herein is used in the common way understood by persons of skill in the art field with regard to patents, and may in some instances function as approximating language. In some instances, the approximating language may correspond to the precision of an instrument for measuring the value.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A shaped charge orientation system, comprising:

a tool string comprising a first perforating gun housing having a first hollow interior and a second perforating gun housing having a second hollow interior;

a first shaped charge holder positioned in the first hollow interior, wherein the first shaped charge holder is oriented in a first direction;

a second shaped charge holder positioned in the second hollow interior, wherein the second shaped charge holder is oriented in a second direction that is different than the first direction; and a manual alignment tool including:

an alignment tool handle extending from an alignment tool body, wherein a portion of the alignment tool body is configured to engage with a structure in the second hollow interior to rotate the second shaped charge holder from the second direction to the first direction, and wherein the second shaped charge holder is secured in the first direction, and an engagement contact pin and an external contact pin provided on opposing surfaces of the alignment tool body, wherein the manual alignment tool is configured to provide an electrical connection to the tool string.

2. The shaped charge orientation system of claim 1, wherein the structure in the second hollow interior comprises a detonator holder provided in the second hollow interior, wherein the detonator holder is coupled to the shaped charge holder, and the shaped charge orientation system further comprises:

a centralizer, wherein the centralizer is coupled to the detonator holder and the portion of the alignment tool body is configured to engage with the centralizer to rotate the second shaped charge holder from the second direction to the first direction.

3. The shaped charge orientation system of claim 2, wherein the centralizer further comprises:

a central tube extending axially along a length of the hollow interior, wherein the detonator holder is provided in the central tube;

a centralizer ring encircling the central tube and in frictional engagement with an inner surface of the second perforating gun housing;

a plurality of spokes extending radially between the central tube and the centralizer ring to connect the central tube to the centralizer ring, wherein an open space is provided between the spokes.

4. The shaped charge orientation system of claim 1, wherein an engagement recess extends inward into the alignment tool body.

5. The shaped charge orientation system of claim 4, wherein the engagement contact pin is included on a surface of the alignment tool body that bounds the engagement recess.

6. The shaped charge orientation system of claim 3, wherein:

the alignment tool body further comprises at least one engagement projection;

the at least one engagement projection is configured to fit in the open space between the spokes.

7. The shaped charge orientation system of claim 6, wherein the at least one engagement projection comprises a first engagement projection extending from the alignment tool body and a second engagement projection extending from the alignment tool body.

8. The shaped charge orientation system of claim 7, wherein an engagement projection channel is provided between the first and second engagement projections.

9. The shaped charge orientation system of claim 6, wherein:

the first perforating gun housing further comprises a marker provided on an outer surface of the perforating gun housing, wherein the marker is positioned radially away from the first shaped charge holder in the first direction;

the manual alignment tool further comprises a laser mounted to the alignment tool body; and the at least one engagement projection is in radial alignment relative to the laser such that a common plane includes the at least one engagement projection channel and the laser.

10. The shaped charge orientation system of claim 7, further comprising:

a ground contact plate extending radially outward from the detonator holder toward an inner surface of the second perforating gun housing, wherein the inner surface has a surface profile including a machined surface portion having a larger diameter relative to an adjacent portion of the inner surface, and the ground contact plate is configured to clip into the machined surface portion to secure an axial position of the detonator holder in the second hollow interior.

11. The shaped charge orientation system of claim 1, wherein the first perforating gun housing is coupled directly to the second perforating gun housing with a corresponding threaded connection.

12. The shaped charge orientation system of claim 1, wherein the first perforating gun housing is coupled to the second perforating gun housing with the use of a sub adapter.

13. The shaped charge orientation system of claim 1, wherein the first direction is zero degrees, and the first and second directions are radially offset from one another about a central longitudinal axis defined by the tool string.

14. A method of manually aligning a first shaped charge holder in a first perforating gun with a second shaped charge holder in a second perforating gun, the method comprising:

positioning the first shaped charge holder in a first direction in the first perforating gun, the first perforating gun comprising a first perforating gun housing having a first housing end, a second housing end, and a first hollow interior;

positioning the second shaped charge holder in the second perforating gun, the second perforating gun comprising a second perforating gun having a first housing end, a second housing end, and a second hollow interior;

connecting the first perforating gun housing to the second perforating gun housing to form at least a portion of a tool string;

engaging a manual alignment tool with a structure in the second hollow interior of the second perforating gun, the alignment tool including an alignment tool handle extending from an alignment tool body, wherein a portion of the alignment tool body engages with the structure in the second hollow interior;

providing an electrical connection to the tool string via an engagement contact pin and an external contact pin provided on opposing surfaces of the alignment tool body;

orienting the second shaped charge holder into an alignment relative to the first shaped charge holder, wherein the alignment is in the first direction, wherein the orienting of the second shaped charge holder comprises rotating the second shaped charge holder independently of the second perforating gun using the manual alignment tool; and securing the alignment of the second shaped charge holder in the first direction.

15. The method of claim 14, further comprising:

marking an outer surface of the first perforating gun housing with a visual indicator in alignment with the first direction; and the securing of the alignment of the second shaped charge holder relative to the second perforating gun housing is done with at least one of a frictional engagement, an anchoring mechanism, a locking mechanism, and a clamping mechanism.

16. The method of claim 14, wherein connecting the first perforating gun housing to the second perforating gun housing further comprises one of:

coupling the first end of the second perforating gun housing directly to the second end of the first perforating gun housing using a corresponding threaded connection; and coupling the first end of the second perforating gun housing to the second end of the first perforating gun housing with the use of a sub assembly.

17. The method of claim 14, wherein the orienting of the second shaped charge holder is achieved without the use of a bearing, swivel, gravitational force, or an eccentric weight distribution.

18. The method of claim 14, wherein orienting the second shaped charge holder further comprises:

inserting an engagement portion of the manual alignment tool into the second perforating gun housing second end;

positioning a structure coupled to the shaped charge holder in a channel formed in the engagement portion; and aligning a beam extending axially from a laser associated with the manual alignment tool with a marker on an outer surface of the first perforating gun housing, wherein the laser beam is radially offset from and transverse to the channel.

19. The method of claim 18, wherein the marker is a strip of tape or a handwritten notation.

20. The method of claim 14, further comprising testing electrical connections of components in the tool string via the electrical connection provided to the tool string via the engagement contact pin and the external contact pin.

* * * * *